US011460049B2

(12) United States Patent
Kawamoto et al.

(10) Patent No.: US 11,460,049 B2
(45) Date of Patent: Oct. 4, 2022

(54) EJECTOR

(71) Applicant: DENSO CORPORATION, Kariya (JP)

(72) Inventors: Yoichiro Kawamoto, Kariya (JP); Kazunori Mizutori, Kariya (JP); Etsuhisa Yamada, Kariya (JP); Teruyuki Hotta, Kariya (JP); Eitaro Tanaka, Kariya (JP)

(73) Assignee: DENSO CORPORATION, Kariya (JP)

( * ) Notice: Subject to any disclaimer, the term of this patent is extended or adjusted under 35 U.S.C. 154(b) by 761 days.

(21) Appl. No.: 16/209,246

(22) Filed: Dec. 4, 2018

(65) Prior Publication Data

US 2019/0107124 A1 Apr. 11, 2019

Related U.S. Application Data

(63) Continuation of application No. PCT/JP2017/016679, filed on Apr. 27, 2017.

(30) Foreign Application Priority Data

Jun. 6, 2016 (JP) ..... JP2016-112855

(51) Int. Cl.
*F04F 5/10* (2006.01)
*F04F 5/46* (2006.01)
(Continued)

(52) U.S. Cl.
CPC ..... *F04F 5/10* (2013.01); *F04F 5/46* (2013.01); *F25B 1/00* (2013.01); *F04F 5/18* (2013.01);
(Continued)

(58) Field of Classification Search
CPC ..... F04F 5/10; F04F 5/18; F04F 5/20; F04F 5/46; F04F 5/48; F04F 5/54; F25B 1/00; F25B 1/10; F25B 2341/0012
See application file for complete search history.

(56) References Cited

U.S. PATENT DOCUMENTS 6,858,340 B2 * 2/2005 Sugawara ..... H01M 8/04104 429/513
7,438,535 B2 * 10/2008 Morishima ..... H01M 8/04097 417/187
(Continued)

FOREIGN PATENT DOCUMENTS

JP 2013177879 A 9/2013
JP 2015137565 A 7/2015
(Continued)

OTHER PUBLICATIONS

U.S. Appl. No. 16/073,824, filed Jul. 30, 2018, Nishijima et al.
U.S. Appl. No. 16/073,889, filed Jul. 30, 2018, Nishijima et al.

*Primary Examiner* — Dominick L Plakkoottam
*Assistant Examiner* — Charles W Nichols
(74) *Attorney, Agent, or Firm* — Harness, Dickey & Pierce, P.L.C.

(57) ABSTRACT

An ejector includes a shaft coupled to a passage formation member defining a refrigerant passage inside a body, and the shaft is slidably supported by a support member fixed to the body. A drive mechanism moves the shaft in an axial direction to change a passage sectional area of the refrigerant passage. The passage formation member is provided with a vibration suppressive member including a first mobile end that applies a load to enlarge the refrigerant passage and a second mobile end that applies a load to narrow the refrigerant passage. Both the first mobile end and the second mobile end are disposed on a same side of a slide region of the support member in the axial direction.

6 Claims, 12 Drawing Sheets

(51) Int. Cl.

| | |
|---|---|
| ***F25B 1/00*** | (2006.01) |
| *F04F 5/18* | (2006.01) |
| *F04F 5/20* | (2006.01) |
| *F04F 5/48* | (2006.01) |
| *F04F 5/54* | (2006.01) |
| *F25B 1/10* | (2006.01) |

(52) U.S. Cl.
CPC . *F04F 5/20* (2013.01); *F04F 5/48* (2013.01); *F04F 5/54* (2013.01); *F25B 1/10* (2013.01); *F25B 2341/0012* (2013.01)

(56) References Cited

U.S. PATENT DOCUMENTS

| | | | | |
|---|---|---|---|---|
| 2004/0255611 | A1* | 12/2004 | Nishijima | F25B 41/00 62/500 |
| 2005/0207902 | A1* | 9/2005 | Bonifacio | F04F 5/461 417/182.5 |
| 2013/0277448 | A1* | 10/2013 | Liu | F25B 49/02 239/11 |
| 2015/0033790 | A1 | 2/2015 | Yamada et al. | |
| 2016/0348948 | A1 | 12/2016 | Takahashi et al. | |

FOREIGN PATENT DOCUMENTS

| | | | |
|---|---|---|---|
| JP | 2015137566 | A | 7/2015 |
| JP | 2017218939 | A | 12/2017 |
| WO | WO-2017179321 | A1 | 10/2017 |

* cited by examiner

EJECTOR

CROSS REFERENCE TO RELATED APPLICATION

The present application is a continuation application of International Patent Application No. PCT/JP2017/016679 filed on Apr. 27, 2017, which designated the United States and claims the benefit of priority from Japanese Patent Application No. 2016-112855 filed on Jun. 6, 2016. The entire disclosures of all of the above applications are incorporated herein by reference.

TECHNICAL FIELD

The present disclosure relates to an ejector.

BACKGROUND

Conventionally, an ejector is included in a vapor-compression refrigeration cycle device. The ejector is configured to suck a refrigerant flowing out of an evaporator through a refrigerant suction port and a suction passage provided in a body by utilizing a suction effect of a refrigerant jetted from a nozzle passage that reduces a pressure of a high-pressure refrigerant. The ejector then causes a refrigerant mixture including the jetted refrigerant and the sucked refrigerant to increase in pressure in a diffuser passage and flow out to an intake end of a compressor.

SUMMARY

According to at least one embodiment of the present disclosure, an ejector includes: a body including a pressure reducing space that has a shape of a solid of revolution and reduces a pressure of refrigerant; a passage formation member at least partially disposed inside the pressure reducing space; a drive mechanism configured to move the passage formation member in an axial direction of the pressure reducing space; a support member that has a cylindrical shape and slidably supports a shaft, the shaft having a cylindrical columnar shape and coupled to the passage formation member, the support member having a slide region on which the shaft is slidable; and a vibration suppressor configured to suppress vibration of the passage formation member. A refrigerant passage provided between an inner peripheral surface of a portion of the body defining the pressure reducing space and an outer peripheral surface of the passage formation member is defined as a nozzle passage. A center axis of the support member is coaxial with a center axis of the pressure reducing space. When viewed in a direction perpendicular to the axial direction of the pressure reducing space, a throat portion of the body at which a passage sectional area of the nozzle passage is smallest in the nozzle passage is positioned outside a range overlapping the slide region of the support portion. The vibration suppressor includes a first elastic member configured to apply a load to the passage formation member in a direction of increasing the passage sectional area of the nozzle passage, and a second elastic member configured to apply a load to the passage formation member in a direction opposite to the direction of the load applied by the first elastic member. An end of the first elastic member that is movable to apply the load to the passage formation member is defined as a first mobile end. An end of the second elastic member that is movable to apply the load to the passage formation member is defined as a second mobile end. When viewed in the direction perpendicular to the axial direction of the pressure reducing space, the first mobile end and the second mobile end are positioned outside the range overlapping the slide region of the support portion, and both the first mobile end and the second mobile end are positioned on a same side of the slide region in the axial direction.

DETAILED DESCRIPTION

Figure 1:
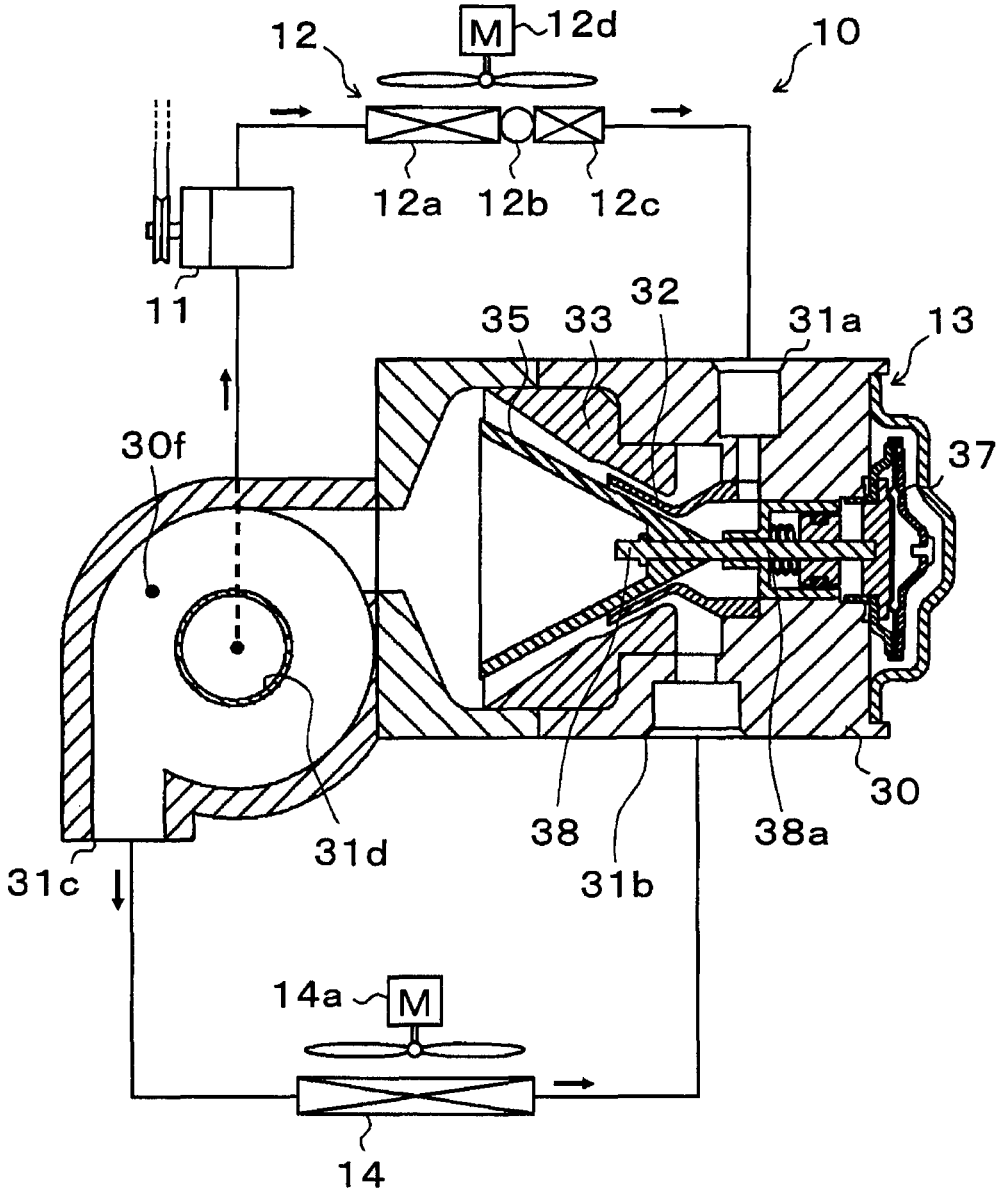
FIG. 1 is a view of an ejector refrigeration cycle according to at least one embodiment.

Hereinafter, multiple embodiments for implementing the present disclosure will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

The first embodiment of the present disclosure will be described with reference to FIGS. 1 to 8. As depicted in FIG. 1, the present embodiment provides an ejector 13 applied to a vapor-compression refrigeration cycle device including an ejector functioning as a refrigerant pressure reducing device, specifically, an ejector refrigeration cycle 10. The ejector refrigeration cycle 10 is applied to a vehicle air conditioner, and achieves a function of cooling blown air to be blown into a vehicle interior as an air conditioned space. The blown air thus serves as cooling target fluid of the ejector refrigeration cycle 10 according to the present embodiment.

The ejector refrigeration cycle 10 according to the present embodiment adopts R134a as a refrigerant, and configures a subcritical refrigeration cycle having high-pressure side refrigerant pressure not exceeding critical pressure of the refrigerant. This refrigerant is mixed with refrigerator oil serving as a lubricant of a compressor 11, and the refrigerator oil partially circulates in the cycle together with the refrigerant.

The compressor 11 as one of component devices of the ejector refrigeration cycle 10 is configured to suck the refrigerant, pressurize the refrigerant to reach high pressure, and discharge the refrigerant. The compressor 11 is disposed in an engine compartment together with an engine (internal combustion engine) that outputs vehicle travelling driving force. The compressor 11 is of an engine driven type and is driven by rotational driving force output from the engine via a pulley, a belt, and the like.

More specifically, the compressor 11 according to the present embodiment is of a swashplate variable capacity type and is configured to change discharge capacity to have adjustable refrigerant discharge capability. The compressor 11 has a discharge capacity control valve (not depicted) configured to change the discharge capacity. The discharge capacity control valve is controlled in terms of its operation in accordance with control current output from a control device to be described later.

The compressor 11 has a discharge port connected to a refrigerant inlet end of a condensing unit 12*a* of a radiator 12. The radiator 12 is a radiation heat exchanger that exchanges heat between a high-pressure refrigerant discharged from the compressor 11 and vehicle exterior air (outside air) blown by a cooling fan 12*d* to radiate heat from the high-pressure refrigerant and cool the high-pressure refrigerant. The radiator 12 is disposed at a vehicle front position in the engine compartment.

More specifically, the radiator 12 is a so-called subcooling condenser including the condensing unit 12*a*, a receiver 12*b*, and a subcooling portion 12*c*.

The condensing unit 12*a* is a condensation heat exchanging unit that exchanges heat between a high pressure gas-phase refrigerant discharged from the compressor 11 and outside air blown from the cooling fan 12*d*, and radiates heat of the high-pressure gas-phase refrigerant to be condensed. The receiver 12*b* is a refrigerant container that reserves an excess liquid-phase refrigerant obtained by gas-liquid separation of the refrigerant flowing out of the condensing unit 12*a*. The subcooling portion 12*c* is a subcooling heat exchanging unit that exchanges heat between the liquid-phase refrigerant having flowed out of the receiver 12*b* and outside air blown from the cooling fan 12*d* to super-cool the liquid-phase refrigerant.

The cooling fan 12*d* is an electric blower having rotational speed (i.e. blown air volume) controlled in accordance with control voltage output from the control device. The ejector 13 has a refrigerant inflow port 31*a* connected to a refrigerant outlet of the subcooling portion 12*c* of the radiator 12.

The ejector 13 functions as a refrigerant pressure reducing device that reduces a pressure of a high-pressure liquid-phase refrigerant being subcooled and flowing out of the radiator 12 and causes the pressure-reduced refrigerant to flow downstream. The ejector 13 further functions as a refrigerant transport device that sucks and transports a refrigerant flowing out of an evaporator 14 to be described later (i.e. the refrigerant at an outlet of the evaporator 14) utilizing suction effect of a refrigerant jetted at high speed.

The ejector 13 according to the present embodiment further functions as a gas-liquid separator that applies gas-liquid separation to a pressure-reduced refrigerant. In other words, the ejector 13 according to the present embodiment is configured as an ejector having a gas-liquid separating function, obtained by integrating (i.e. modularizing) an ejector and a gas-liquid separator. The ejector 13 is disposed in the engine compartment together with the compressor 11 and the radiator 12.

Figure 2:
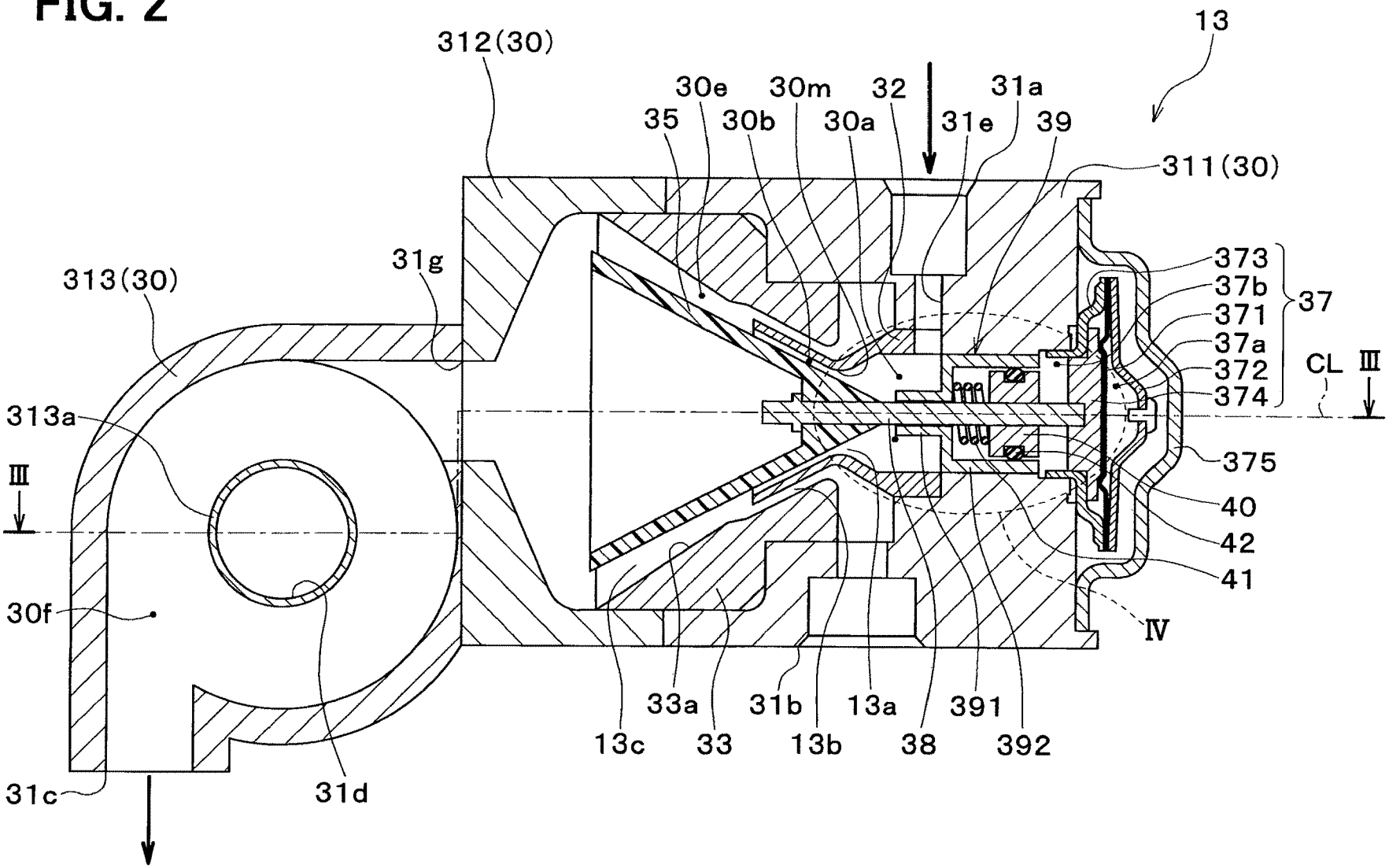
FIG. 2 is an axial sectional view of an ejector according to at least one embodiment.
Figure 3:
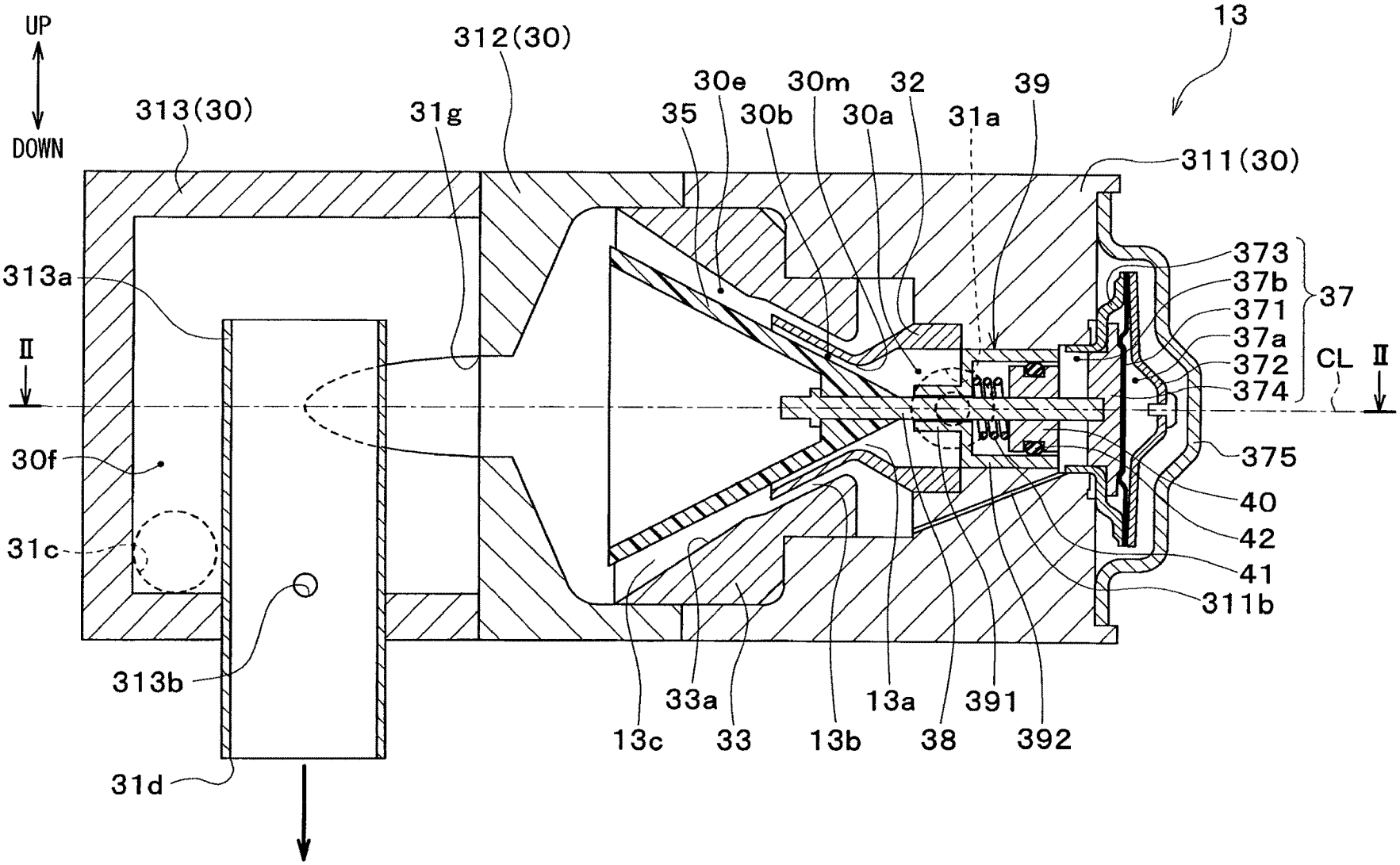
FIG. 3 is a sectional view taken along line III-III shown in FIG. 2.

The ejector 13 will be described in terms of a specific configuration with reference to FIGS. 2 to 4. FIGS. 2 and 3 are axial sectional views of the ejector 13. Specifically, FIG. 2 is a sectional view taken along line II-II shown in FIG. 3, and FIG. 3 is a sectional view taken along line III-III shown in FIG. 2. FIG. 3 includes upward and downward arrows indicating up and down directions of the ejector 13 mounted to a vehicle.

As depicted in FIGS. 2 and 3, the ejector 13 according to the present embodiment includes a body 30 configured by a plurality of combined components.

More specifically, the body 30 includes an upper body 311, a lower body 312, a gas-liquid separation body 313, and the like. The upper body 311, the lower body 312, and the gas-liquid separation body 313 form an outer shell of the ejector 13 and function as a housing internally accommodating the remaining components.

The upper body 311, the lower body 312, and the gas-liquid separation body 313 are each configured by a hollow member made of metal (aluminum alloy in the present embodiment). The upper body 311, the lower body 312, and the gas-liquid separation body 313 can alternatively be made of resin.

The upper body 311 and the lower body 312 combined together form an internal space, to which components of the body 30 such as a nozzle body 32 and a diffuser body 33 to be described later are fixed.

The upper body 311 is provided with a plurality of refrigerant inflow ports such as the refrigerant inflow port 31*a* and a refrigerant suction port 31*b*. The refrigerant inflow port 31*a* receives a high-pressure refrigerant flowing out of the radiator 12. The refrigerant suction port 31*b* sucks a low-pressure refrigerant flowing out of the evaporator 14.

The gas-liquid separation body 313 is provided with a plurality of refrigerant outflow ports such as a liquid-phase refrigerant outflow port 31*c* and a gas-phase refrigerant outflow port 31*d*. The liquid-phase refrigerant outflow port 31*c* causes a liquid-phase refrigerant obtained by separation in a gas-liquid separation space 30*f* provided inside the gas-liquid separation body 313 to flow out toward a refrigerant inlet of the evaporator 14. The gas-phase refrigerant outflow port 31*d* causes a gas-phase refrigerant obtained by separation in the gas-liquid separation space 30*f* to flow out toward an intake port of the compressor 11.

The nozzle body 32 is configured by a cylindrical member made of metal (stainless steel in the present embodiment). As depicted in FIGS. 2 and 3, the nozzle body 32 is disposed on a bottom surface, adjacent to the lower body 312, of the upper body 311. The nozzle body 32 is fixed into a hole provided in the upper body 311 by press fitting to prevent leakage of the refrigerant through a gap between the upper body 311 and the nozzle body 32.

The nozzle body 32 is provided therein with an inflow space 30*a* that receives the refrigerant flowing from the refrigerant inflow port 31*a*. The inflow space 30*a* is formed in a shape of a substantially columnar solid of revolution. The inflow space 30*a* has a center axis disposed coaxially with a center axis CL of a pressure reducing space 30*b* to be described later. As being apparent from FIG. 3, the center axis CL according to the present embodiment extends substantially horizontally. The shape of a solid of revolution has a cubic shape formed by rotating a planar figure about a single straight line (center axis) on an identical plane.

The upper body 311 is provided with a refrigerant inflow passage 31*e* that guides the high-pressure refrigerant flowing from the refrigerant inflow port 31*a* into the inflow space 30*a*. The refrigerant inflow passage 31*e* is shaped to radially extend when viewed axially along the inflow space 30*a*, to cause the refrigerant flowing into the inflow space 30*a* to flow toward the center axis of the inflow space 30*a*.

The pressure reducing space 30*b* is provided inside the nozzle body 32, downstream in the refrigerant flow of the inflow space 30*a*, and continuously to the inflow space 30*a*, to reduce the pressure of the refrigerant flowing out of the inflow space 30*a* and cause the refrigerant to flow downstream.

The pressure reducing space 30*b* has a shape of a solid of revolution obtained by coupling tops of two spaces each having a truncated cone shape. The nozzle body 32 is provided with a throat portion 30*m* that has a minimized passage sectional area in the pressure reducing space 30*b* (specifically, a nozzle passage 13*a* to be described later).

The pressure reducing space 30*b* is provided therein with a top of a passage formation member 35 having a conical shape. The passage formation member 35 is a valve configured to be axially displaced to change a passage sectional area of a refrigerant passage provided in the ejector 13.

The passage formation member 35 has the conical shape with an outer diameter gradually increased as the passage formation member 35 departs from the pressure reducing space 30*b* (in other words, toward a refrigerant flow downstream side). There is accordingly provided the refrigerant passage having an axially perpendicular section in an annular shape, between an inner peripheral surface of a portion forming the pressure reducing space 30*b* of the nozzle body 32 and an outer peripheral surface of a portion adjacent to the top of the passage formation member 35. The passage formation member 35 will be described later in terms of a more detailed configuration thereof.

This refrigerant passage corresponds to the nozzle passage 13*a* functioning as a nozzle configured to isentropically reduce a pressure of a refrigerant and jet the pressure-reduced refrigerant. The nozzle passage 13*a* has a passage sectional area decreased from an end adjacent to the inflow space 30*a* toward the throat portion 30*m* and increased from the throat portion 30*m* toward the refrigerant flow downstream side. The passage sectional area of the nozzle passage 13*a* is changed similarly to a so-called Laval nozzle.

The nozzle passage 13*a* according to the present embodiment is thus configured to reduce the pressure of the refrigerant as well as jet the refrigerant at flow speed increased to reach supersonic speed.

The diffuser body 33 is disposed inside the upper body 311 and downstream in the refrigerant flow of the nozzle body 32. The diffuser body 33 is configured by a cylindrical member made of metal (aluminum alloy in the present embodiment).

The diffuser body 33 has an outer circumference press fitted to an inner peripheral side surface of the upper body 311 to be fixed into the upper body 311. There is disposed an O-ring (not depicted) serving as a sealing member, between an outer peripheral surface of the diffuser body 33 and an inner peripheral surface of the upper body 311, to prevent leakage of the refrigerant through a gap between the diffuser body 33 and the upper body 311.

The diffuser body 33 has a center portion provided with a through hole 33*a* penetrating axially. The through hole 33*a* has a center axis disposed coaxially with the center axis CL of the inflow space 30*a* and the pressure reducing space 30*b*. The through hole 33*a* has a substantially truncated cone shape having a sectional area gradually increased toward the refrigerant flow downstream side. Furthermore, the nozzle body 32 according to the present embodiment has a distal end positioned adjacent to a refrigerant jet port and extending into the through hole 33*a* of the diffuser body 33.

There is provided, between an inner peripheral surface of the through hole 33*a* of the diffuser body 33 and an outer peripheral surface of the cylindrical distal end of the nozzle body 32, a downstream portion of a suction passage 13*b* guiding the refrigerant sucked from the refrigerant suction port 31*b* toward the refrigerant flow downstream side of the pressure reducing space 30*b* (i.e. the nozzle passage 13*a*). The suction passage 13*b* has a most downstream portion serving as a sucked refrigerant outlet annularly opened toward an outer circumference of the refrigerant jet port when viewed axially.

There is provided a pressurization space 30*e* downstream in the refrigerant flow of the suction passage 13*b*, in the through hole 33*a* of the diffuser body 33. The pressurization space 30*e* has a substantially truncated conical shape gradually expanding along the refrigerant flow. The pressurization space 30*e* receives the refrigerant jetted from the nozzle passage 13*a* and the refrigerant sucked from the suction passage 13*b*.

The pressurization space 30*e* is provided therein with a portion downstream in the refrigerant flow of the top of the passage formation member 35. There is provided a refrigerant passage having an axially perpendicular section in an annular shape, between an inner peripheral surface of a portion configuring the pressurization space 30*e* of the diffuser body 33 and the outer peripheral surface adjacent to the refrigerant flow downstream side, of the passage formation member 35.

This refrigerant passage configures a diffuser passage 13*c* functioning as a pressurizing portion that is configured to mix and pressurize the jetted refrigerant and the sucked refrigerant. The diffuser passage 13*c* has a passage sectional area gradually increased toward the refrigerant flow downstream side. The diffuser passage 13*c* can thus achieve conversion from velocity energy of the refrigerant mixture including the jetted refrigerant and the sucked refrigerant to pressure energy.

The passage formation member 35 will be described next in terms of the detailed configuration. The passage formation member 35 is configured by a conical member made of resin (nylon 6 or nylon 66 in the present embodiment) having resistance to a refrigerant. The passage formation member 35 has an internal space provided from a bottom surface and having a substantially truncated conical space. In other words, the passage formation member 35 has a vessel shape (i.e. a cup shape).

The passage formation member 35 is coupled with a shaft 38. The shaft 38 is a columnar member made of metal (stainless steel in the present embodiment). The shaft 38 is insert-molded to the passage formation member 35. This achieves integration between the passage formation member 35 and the shaft 38. The passage formation member 35 has a center axis disposed coaxially with a center axis of the shaft 38.

The shaft 38 has a first end portion (i.e. adjacent to the inflow space 30*a*) projecting from the top of the passage formation member 35 and extending toward the inflow space 30*a*. The first end portion of the shaft 38 is slidably supported by a support member 39 that is fixed to the upper body 311.

The support member 39 slidably supports the shaft 38 to suppress inclination of a displacement direction of the passage formation member 35 from the center axis of the pressure reducing space 30*b*. The support member 39 is configured by a cylindrical member made of metal (stainless steel similarly to the shaft 38 in the present embodiment).

Figure 4:
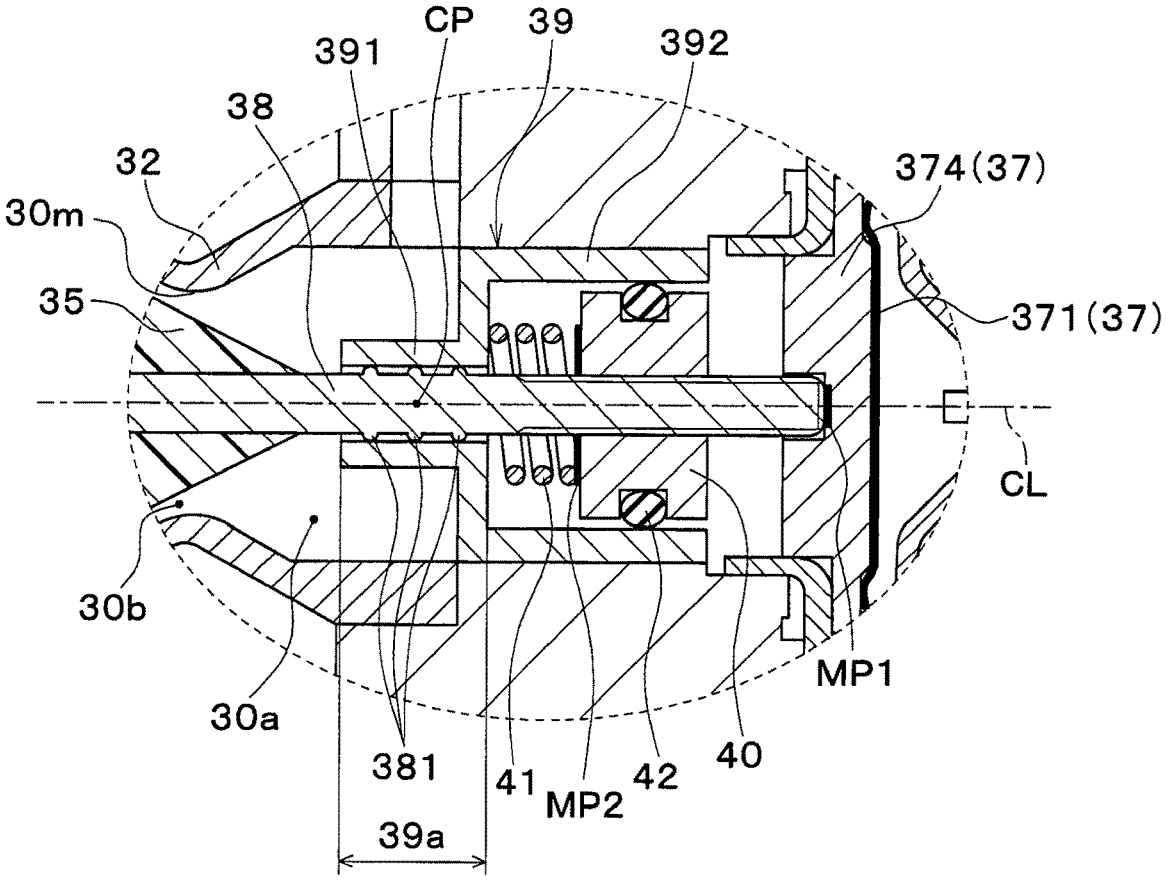
FIG. 4 is an enlarged sectional view of a part IV shown in FIG. 2.

More specifically, the support member 39 has two cylindrical portions different from each other in diameter, as depicted in an enlarge view in FIG. 4. The two cylindrical portions include a small diameter portion 391 adjacent to the passage formation member 35 and a large diameter portion 392 distant from the passage formation member 35. The shaft 38 is slidably supported in the small diameter portion 391. The small diameter portion 391 has an inner peripheral surface configuring a slide region 39*a* allowing slide of the shaft 38.

As depicted in FIG. 4, the shaft 38 has an outer peripheral surface including a range that is possibly in contact with the slide region 39*a* and is provided with a plurality of projections 381. The plurality of projections 381 projects toward the inner peripheral surface of the small diameter portion 391 of the support member 39 to be in point contact with the peripheral surface of the small diameter portion 391.

The large diameter portion 392 has an outer peripheral surface fixed into the hole provided in the upper body 311 by press fitting. This prevents leakage of the refrigerant through a gap between an outer circumference of the large diameter portion 392 and the upper body 311. The large diameter portion 392 according to the present embodiment is fixed to the upper body 311 such that a center axis of the small diameter portion 391 is disposed coaxially with the center axis CL of the pressure reducing space 30*b*.

The center axis of the shaft 38 supported by the small diameter portion 391 can thus ideally be disposed coaxially with the center axis CL of the pressure reducing space 30*b*. There is actually a gap between the outer peripheral surface of the shaft 38 and the inner peripheral surface of the small diameter portion 391. The shaft 38 may thus have a displacement direction inclined from the center axis of the small diameter portion 391.

The large diameter portion 392 is provided therein with a coil spring 41. The coil spring 41 is an elastic member applying a load to the shaft 38 in a direction of decreasing the passage sectional area of the throat portion 30*m* by the passage formation member 35.

More specifically, fixed to the shaft 38 is a load receiving member 40 that is in contact with the coil spring 41 and receives a load from the coil spring 41. The load receiving member 40 is configured by a cylindrical member made of metal (aluminum alloy in the present embodiment). The load receiving member 40 is fixed by means of screw fastening to an outer circumference of the shaft 38.

The load receiving member 40 has an outer diameter slightly smaller than an inner diameter of the large diameter portion 392 of the support member 39. There is accordingly provided a gap between an outer peripheral surface of the load receiving member 40 and an inner peripheral surface of the large diameter portion 392. The load receiving member 40 according to the present embodiment thus has an annular groove provided in an outer circumference and receiving an O-ring 42 serving as a sealing member.

This prevents leakage of the refrigerant through the gap between the outer peripheral surface of the load receiving member 40 and the inner peripheral surface of the large diameter portion 392. Furthermore, the load receiving member 40 is fixed to the shaft 38 such that the O-ring 42 seals the gap in an entire displaceable range of the shaft 38.

The first end portion of the shaft 38 has a distal end coupled to a drive mechanism 37 as depicted in FIGS. 2 and 3. The drive mechanism 37 outputs driving force axially displacing the passage formation member 35 and the shaft 38. In other words, the drive mechanism 37 axially displaces the passage formation member 35 to change the passage sectional area of the throat portion 30*m* and the like of the nozzle passage 13*a*.

More specifically, the drive mechanism 37 is disposed outside the upper body 311 and on an axially extended line of the shaft 38, as depicted in FIGS. 2 and 3. The drive mechanism 37 includes a diaphragm 371, an upper cover 372, a lower cover 373, and the like.

The upper cover 372 is an enclosure space formation member partially defining an enclosure space 37*a* in cooperation with the diaphragm 371. The upper cover 372 is a cup-shaped member made of metal (stainless steel in the present embodiment).

The enclosure space 37*a* encloses a temperature sensitive medium having pressure changed in accordance with temperature change. More specifically, the enclosure space 37*a* encloses the temperature sensitive medium composed equivalently to the refrigerant circulating in the ejector refrigeration cycle 10 to achieve predetermined enclosure density.

The temperature sensitive medium according to the present embodiment can be a medium containing R134a as a main component (e.g. a medium mixture containing R134a and helium). The enclosure density of the temperature sensitive medium is set to achieve appropriate displacement of the passage formation member 35 during normal operation of the cycle, as to be described later.

The lower cover 373 is an introduction space formation member defining an introduction space 37*b* in cooperation with the diaphragm 371. The lower cover 373 is made of a metal member similar to that of the upper cover 372. The introduction space 37*b* allows introduction of the refrigerant sucked from the refrigerant suction port 31*b* through a communication passage 311*b* provided in the upper cover 372.

The upper cover 372 and the lower cover 373 have outer peripheral edges fixed to each other by means of caulking or the like. Furthermore, the diaphragm 371 has an outer peripheral portion sandwiched between the upper cover 372 and the lower cover 373. The diaphragm 371 thus partitions a space provided between the upper cover 372 and the lower cover 373 into the enclosure space 37*a* and the introduction space 37*b*.

The diaphragm 371 is a pressure responsive member displaced in accordance with pressure difference between the internal pressure of the enclosure space 37*a* and the pressure of the sucked refrigerant flowing through the suction passage 13*b*. The diaphragm 371 is desirably made of a material having excellent elasticity, pressure resistance, and airtightness. The diaphragm 371 according to the present embodiment is thus configured by a metal thin plate made of stainless steel (SUS 304).

There is disposed, adjacent to the introduction space 37*b* of the diaphragm 371, a plate member 374 having a disk shape, made of metal (aluminum alloy in the present embodiment), and being in contact with the diaphragm 371. The plate member 374 is coupled to the distal end of the shaft 38.

The diaphragm 371 according to the present embodiment is configured by the metal thin plate having excellent elasticity. Furthermore, the diaphragm 371 is bent toward the enclosure space 37*a*. The diaphragm 371 thus serves as an elastic member applying a load to the shaft 38 in a direction of increasing the passage sectional area of the throat portion 30*m* by the passage formation member 35.

Specifically, the diaphragm 371 corresponds to a first elastic member applying a load to the passage formation member 35 in the direction of increasing the passage sectional area of the throat portion 30*m*. The coil spring 41 described earlier corresponds to a second elastic member applying a load to the passage formation member 35 in a direction opposite to the direction of the load applied by the first elastic member (i.e. the direction of decreasing the passage sectional area of the throat portion 30*m*).

In the present embodiment, as shown by a bold solid line on the right in FIG. 4, an end of the first elastic member (a contact portion between the plate member 374 and the distal end of the shaft 38 in the present embodiment) that is movable to apply a load to the shaft 38 is defined as a first mobile end MP1. As shown by a bold solid line on the left in FIG. 4, an end of the second elastic member (a contact portion between the load receiving member 40 and the coil spring 41 in the present embodiment) that is movable to apply a load to the shaft 38 (specifically, the load receiving member 40) is defined as a second mobile end MP2.

The shaft 38 and the passage formation member 35 according to the present embodiment are thus displaced to balance a total load of a load received from the drive mechanism 37 (specifically, the diaphragm 371) at the first mobile end MP1 and a load received from the coil spring 41 at the second mobile end MP2.

More specifically, increase in temperature (degree of superheat SH) of the refrigerant at the outlet of the evaporator 14 leads to increase in saturation pressure of the temperature sensitive medium enclosed in the enclosure space 37*a* and increase in pressure difference obtained by subtracting internal pressure of the introduction space 37*b* from the internal pressure of the enclosure space 37*a*. Accordingly, the diaphragm 371 is displaced toward the introduction space 37*b* to balance the total load.

When the refrigerant is increased in temperature (degree of superheat SH) at the outlet of the evaporator 14, the passage formation member 35 is displaced to increase the passage sectional area of the throat portion 30*m*.

In contrast, decrease in temperature (degree of superheat SH) of the refrigerant at the outlet of the evaporator 14 leads to decrease in saturation pressure of the temperature sensitive medium enclosed in the enclosure space 37*a* and decrease in pressure difference obtained by subtracting the internal pressure of the introduction space 37*b* from the internal pressure of the enclosure space 37*a*. Accordingly, the diaphragm 371 is displaced toward the enclosure space 37*a* to balance the total load.

When the refrigerant is decreased in temperature (degree of superheat SH) at the outlet of the evaporator 14, the passage formation member 35 is displaced to decrease the passage sectional area of the throat portion 30*m*.

The drive mechanism 37 according to the present embodiment is configured as a mechanical mechanism, and the diaphragm 371 displaces the passage formation member 35 in accordance with the degree of superheat SH of the refrigerant at the outlet of the evaporator 14. The passage sectional area of the throat portion 30*m* is adjusted such that the degree of superheat SH of the refrigerant at the outlet of the evaporator 14 approaches predetermined reference degree of superheat KSH. The reference degree of superheat KSH can alternatively be changed by adjusting a position of attaching the load receiving member 40 to the shaft 38.

The first elastic member (i.e. the diaphragm 371) and the second elastic member (i.e. the coil spring 41) also serve as vibration suppressive members suppressing vibration of the passage formation member 35 caused by externally transmitted vibration.

As depicted in FIG. 4, both the first mobile end MP1 and the second mobile end MP2 are, when viewed in the direction perpendicular to the center axis CL, disposed outside a range overlapping the slide region 39*a* of the support member 39 and is disposed on one end side of the slide region 39*a* (opposite to the passage formation member 35 in the present embodiment).

The throat portion 30*m* of the nozzle passage 13*a* is, when viewed in the direction perpendicular to the center axis CL, disposed outside the range overlapping the slide region 39*a* of the support member 39 and is disposed on another end side of the slide region 39*a* in the axial direction (adjacent to the passage formation member 35 in the present embodiment). The throat portion 30*m* is disposed to become closest to the other end of the slide region 39*a* in the axial direction in an allowable range where the throat portion 30*m* can be disposed.

As to be described later with reference to FIG. 6, when viewed in the direction perpendicular to the center axis CL, both the first mobile end MP1 and the second mobile end MP2 are disposed on the same side of the slide region 39*a* in the axial direction which is opposite from another side of the slide region 39*a* on which the throat portion 30*m* is disposed.

As depicted in FIGS. 2 and 3, the ejector 13 according to the present embodiment includes a cover member 375 covering the drive mechanism 37 and disposed on an outer periphery of the drive mechanism 37. This suppresses influence of temperature of outside air in the engine compartment on the temperature sensitive medium in the enclosure space 37*a*.

The lower body 312 is provided, downstream thereof in the refrigerant flow, with a refrigerant mixture outflow port 31*g*. The refrigerant mixture outflow port 31*g* causes a gas-liquid refrigerant mixture flowing out of the diffuser passage 13*c* to flow out toward the gas-liquid separation space 31*f* provided in the gas-liquid separation body 313. The refrigerant mixture outflow port 31*g* has a passage sectional area set to be smaller than the passage sectional area of a most downstream portion of the diffuser passage 13*c*.

The gas-liquid separation body 313 has a cylindrical shape. The gas-liquid separation space 30*f* is provided in the gas-liquid separation body 313. The gas-liquid separation space 30*f* is defined to have a substantially cylindrical shape of a solid of revolution. The gas-liquid separation body 313 and the gas-liquid separation space 30*f* each have a center axis extending vertically. The center axes of the gas-liquid separation body 313 and the gas-liquid separation space 30*f* are thus orthogonal to the center axis CL.

Furthermore, the gas-liquid separation body 313 is disposed to allow the refrigerant flowing into the gas-liquid separation space 30*f* from the refrigerant mixture outflow port 31*g* of the lower body 312 to flow along an outer circumferential wall surface of the gas-liquid separation space 30*f*. The refrigerant is thus separated into gas and liquid in the gas-liquid separation space 30*f* due to centrifugal force generated by the refrigerant swirling about the center axis.

The gas-liquid separation body 313 is provided, at an axial center, with a pipe 313*a* that has a cylindrical shape, is disposed coaxially with the gas-liquid separation space 30*f*, and extends vertically. The gas-liquid separation body 313 has a cylindrical side surface adjacent to a bottom surface, provided with the liquid-phase refrigerant outflow port 31*c* that causes the liquid-phase refrigerant separated in the gas-liquid separation space 30*f* to flow out along the outer circumferential wall surface of the gas-liquid separation space 30*f*. Furthermore, the pipe 313*a* is provided, at a lower end, with the gas-phase refrigerant outflow port 31*d* that causes the gas-phase refrigerant separated in the gas-liquid separation space 30*f* to flow out.

The pipe 313*a* has a root portion in the gas-liquid separation space 30*f* (i.e. a lowermost portion in the gas-liquid separation space 30*f*), and the root portion has an oil return hole 313*b* allowing communication between the gas-liquid separation space 30*f* and a gas-phase refrigerant passage provided in the pipe 313*a*. The oil return hole 313*b* serves as a communication passage allowing the refrigerator oil dissolved in the liquid-phase refrigerant to return into the compressor 11 through the gas-phase refrigerant passage together with the liquid-phase refrigerant.

As depicted in FIG. 1, the liquid-phase refrigerant outflow port 31*c* of the ejector 13 is connected to the refrigerant inlet of the evaporator 14. The evaporator 14 functions as a heat-absorption heat exchanger that exchanges heat between the low-pressure refrigerant whose pressure has been reduced by the ejector 13 and blown air from a blower fan 14*a* into the vehicle interior to evaporate the low-pressure refrigerant and exert heat absorption effect.

The blower fan 14*a* is an electric blower having rotational speed (blown air volume) controlled in accordance with control voltage output from the control device. The evaporator 14 has a refrigerant outlet connected to the refrigerant suction port 31*b* of the ejector 13. Furthermore, the gas-phase refrigerant outflow port 31*d* of the ejector 13 is connected to the intake port of the compressor 11.

The control device (not depicted) includes a known microcomputer provided with a CPU, a ROM, a RAM, and the like, and a peripheral circuit of the microcomputer. The control device executes various calculations and processing in accordance with a control program stored in the ROM. The control device controls operation of the various electric actuators 11, 12*d*, 14*a*, and the like.

The control device is connected with a plurality of air conditioning control sensors such as an inside air temperature sensor, an outside air temperature sensor, a solar sensor, an evaporator temperature sensor, and a discharge pressure sensor, and the control device receives detection values from these sensors.

More specifically, the inside air temperature sensor functions as an inside air temperature detector that detects vehicle interior temperature. The outside air temperature sensor functions as an outside air temperature detector that detects outside air temperature. The solar sensor functions as a solar radiation quantity detector that detects quantity of solar radiation to the vehicle interior. The evaporator temperature sensor functions as an evaporator temperature detector that detects temperature of air blowing out of the evaporator 14 (evaporator temperature). The discharge pressure sensor functions as an outlet pressure detector that detects pressure of the refrigerant at the outlet of the radiator 12.

The control device has an input end connected with an operation panel (not depicted) disposed adjacent to an instrument panel positioned in a front portion of the vehicle interior. The control device receives operation signals from various operation switches provided on the operation panel. The various operation switches provided on the operation panel include an air conditioning operation switch to be operated to request air conditioning of the vehicle interior, and a vehicle interior temperature setting switch operated to set temperature of the vehicle interior.

The control device according to the present embodiment integrally includes controllers that control operation of various control target devices connected to an output end of the control device. The control device includes a configuration (hardware and software) that controls operation of each of the control target devices and embodies a dedicated controller of the corresponding control target device.

For example, the present embodiment provides a configuration that controls operation of the discharge capacity control valve of the compressor 11 to control refrigerant discharge capability of the compressor 11, and embodies a discharge capability controller. The discharge capability controller can obviously be configured by another control device separate from the control device.

The present embodiment adopting the above configuration will be described next in terms of operation with reference to a Mollier diagram in FIG. 5. When the operation switch on the operation panel is turned ON, the control device actuates the discharge capacity control valve of the compressor 11, the cooling fan 12*d*, the blower fan 14*a*, and the like. The compressor 11 accordingly sucks, compresses, and discharges the refrigerant. The control device enhances refrigerant discharge capability of the compressor 11 in accordance with increase in thermal load of the ejector refrigeration cycle 10.

The high-pressure refrigerant having high temperature and discharged from the compressor 11 (a point a in FIG. 5) flows into the condensing unit 12*a* of the radiator 12, exchanges heat with outside air blown from the cooling fan 12*d*, and radiates heat to be condensed. The refrigerant condensed by the condensing unit 12*a* is separated into gas and liquid at the receiver 12*b*. The liquid-phase refrigerant obtained through gas-liquid separation at the receiver 12*b* exchanges heat with outside air blown from the cooling fan 12*d* at the subcooling portion 12*c*, and further radiates heat to transition into a subcooled liquid-phase refrigerant (from the point a to a point b in FIG. 5).

Figure 5:
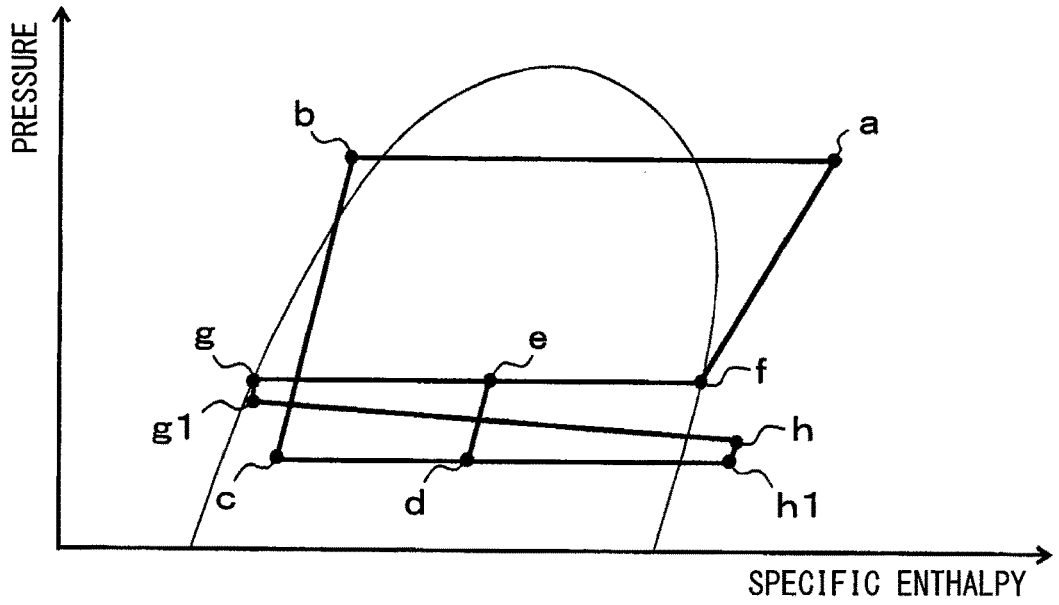
FIG. 5 is a Mollier diagram showing change in state of a refrigerant in the ejector refrigeration cycle according to at least one embodiment.

The subcooled liquid-phase refrigerant flowing out of the subcooling portion 12*c* of the radiator 12 is isentropically pressure-reduced in the nozzle passage 13*a* provided between an inner peripheral surface of the pressure reducing space 30*b* and the outer peripheral surface of the passage formation member 35 in the ejector 13, and is then jetted (from the point b to a point c in FIG. 5). The passage sectional area of the throat portion 30*m* of the pressure reducing space 30*b* is adjusted to cause the degree of superheat of the refrigerant at the outlet of the evaporator 14 (a point h in FIG. 5) to approach the reference degree of superheat KSH.

Furthermore, the refrigerant flowing out of the evaporator 14 (the point h in FIG. 5) is sucked through the refrigerant suction port 31*b* and the suction passage 13*b* due to suction effect of the refrigerant jetted from the nozzle passage 13*a*. The refrigerant jetted from the nozzle passage 13*a* and the refrigerant sucked through the suction passage 13*b* flow into the diffuser passage 13*c* to be merged (from the point c to a point d and from a point h1 to the point d in FIG. 5).

The most downstream portion of the suction passage 13*b* according to the present embodiment is formed to be gradually decreased in passage sectional area along the refrigerant flow. The sucked refrigerant passing through the suction passage 13*b* is accordingly increased in flow speed while being decreased in pressure (from the point h to the point h1 in FIG. 5). This decreases difference in speed between the sucked refrigerant and the jetted refrigerant and achieves reduction in energy loss (mixing loss) when the sucked refrigerant and the jetted refrigerant are mixed in the diffuser passage 13*c*.

The refrigerant in the diffuser passage 13*c* has kinetic energy converted to pressure energy due to increase in passage sectional area. This increases pressure of the refrigerant mixture while the jetted refrigerant and the sucked refrigerant are being mixed together (from the point d to a point e in FIG. 5). The refrigerant flowing out of the diffuser passage 13*c* is separated into gas and liquid in the gas-liquid separation space 30*f* (from the point e to a point f and from the point e to a point g in FIG. 5).

The liquid-phase refrigerant separated in the gas-liquid separation space 30*f* flows into the evaporator 14 with pressure loss while flowing through a refrigerant flow path from the ejector 13 to the evaporator 14 (from the point g to a point g1 in FIG. 5). The refrigerant flowing into the evaporator 14 absorbs heat of blown air from the blower fan 14*a*, and evaporates (from the point g1 to the point h in FIG. 5). This leads to cooling blown air.

Meanwhile, the gas-phase refrigerant separated in the gas-liquid separation space 30*f* flows out of the gas-phase refrigerant outflow port 31*d*, is sucked into the compressor 11, and is compressed again (from the point f to the point a in FIG. 5).

The ejector refrigeration cycle 10 according to the present embodiment operates as described above, to achieve cooling blown air into the vehicle interior.

In the ejector refrigeration cycle 10, the refrigerant pressurized in the diffuser passage 13*c* is sucked to the compressor 11. The ejector refrigeration cycle 10 can thus achieve reduction in power consumption of the compressor 11 and improvement in coefficient of performance (COP) of the cycle, in comparison with an ordinary refrigeration cycle device having refrigerant evaporating pressure at an evaporator substantially equal to pressure of a refrigerant sucked into a compressor.

The ejector 13 according to the present embodiment includes the drive mechanism 37, so that the passage formation member 35 is displaced in accordance with load variation of the ejector refrigeration cycle 10 to adjust the passage sectional area of the nozzle passage 13*a* (the passage sectional area of the throat portion 30*m*) and the passage sectional area of the diffuser passage 13*c*.

The ejector 13 can thus be operated appropriately in accordance with a flow rate of the refrigerant circulating in the ejector refrigeration cycle 10 with the passage sectional areas of the refrigerant passages (namely, the nozzle passage 13*a* and the diffuser passage 13*c*) provided therein being changed in accordance with load variation of the ejector refrigeration cycle 10.

The ejector 13 according to the present embodiment includes the vibration suppressive members (i.e. the first elastic member and the second elastic member), to attenuate vibration of the passage formation member 35 caused by externally transmitted vibration or pressure pulsation occurring when the refrigerant is pressure-reduced. The ejector 13 can thus entirely be enhanced in vibration proof performance.

The ejector 13 according to the present embodiment includes the vibration suppressive members, namely, the first elastic member (i.e. the diaphragm 371) applying a load in the direction of increasing the passage sectional area of the throat portion 30*m* of the nozzle passage 13*a*, and the second elastic member (i.e. the coil spring 41) applying a load in the direction of decreasing the passage sectional area of the throat portion 30*m*.

The elastic members applying loads to the passage formation member 35 thus have a total spring constant equal to a total value of a spring constant of the first elastic member and a spring constant of the second elastic member. This configuration achieves a higher character frequency of a vibration system including the passage formation member 35, in comparison with a configuration including only one of the first elastic member and the second elastic member. The vibration system including the passage formation member 35 is accordingly suppressed from resonating with externally transmitted vehicle vibration and the like.

For increase in passage sectional area of the nozzle passage 13*a*, the drive mechanism 37 needs driving force equal to difference between the load applied by the first elastic member and the load applied by the second elastic member. Increase in high character frequency of the vibration system including the passage formation member 35 will not cause increase in driving force of the drive mechanism 37 for increase in passage sectional area of the nozzle passage 13*a* and the like. Accordingly, the drive mechanism 37 does not need to be increased in size for increase in driving force of the drive mechanism 37.

The ejector according to the present embodiment includes the first elastic member and the second elastic member. The first elastic member and the second elastic member may apply loads along the center axis CL to the passage formation member 35 and the shaft 38 as well as loads perpendicular to the center axis CL (i.e. transverse force).

As described earlier, the displacement direction of the passage formation member 35 and the shaft 38 may thus be inclined from the center axis of the support member 39 (i.e. the center axis CL). Such inclination increases frictional force between the shaft 38 and the support member 39 to cause deterioration in responsiveness and increase in hysteresis upon displacement of the passage formation member 35 by the drive mechanism 37.

When the displacement direction of the passage formation member 35 and the like is inclined from the center axis of the support member 39, the passage sectional area of the nozzle passage 13*a* or the like may not be changed to have an appropriate size according to load variation even through the drive mechanism 37 outputs driving force in accordance with load variation of the ejector refrigeration cycle 10.

Furthermore, the displacement direction of the passage formation member 35 being inclined from the center axis CL may cause circumferential ununiformity in annular sectional shape of the refrigerant passage like the nozzle passage 13*a*. This may destabilize the passage sectional area of the throat portion 30*m* of the nozzle passage 13*a* when the drive mechanism 37 displaces the passage formation member 35, and thereby may destabilize a flow rate of the refrigerant flowing through the nozzle passage 13*a*. As a result, an energy conversion efficiency may be reduced in the nozzle passage 13*a*.

In view thereof, the ejector 13 according to the present embodiment has the first mobile end MP1 and the second mobile end MP2 that are, when viewed in the direction perpendicular to the center axis CL, disposed outside the range overlapping the slide region 39*a* as well as are both disposed on the same side of the slide region 39*a* in the axial direction. Both the first mobile end MP1 and the second mobile end MP2 can thus be disposed close to the one axial end of the slide region 39*a*.

This configuration thus shortens distance from a rotation center CP to the first mobile end MP1 as well as distance from the rotation center CP to the second mobile end MP2 in the case where the center axis of the shaft 38 is inclined from the center axis of the support member 39. The present embodiment accordingly decreases maximum torque M generated by transverse force applied to the shaft 38 from the first elastic member and the second elastic member.

The rotation center CP of the shaft is a point on the center axis of the support member 39 (i.e. a point on the center axis CL) and can be defined as an axial center point of the slide region 39*a*, as depicted in FIG. 4 and the like.

Figure 7:
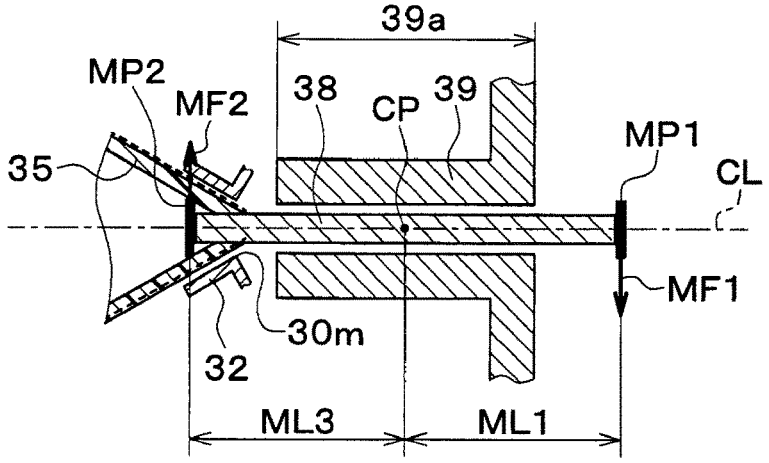
FIG. 7 is an explanatory view schematically showing positional relation among a first mobile end, a second mobile end, a rotation center, and the like according to at least one embodiment.
Figure 8:
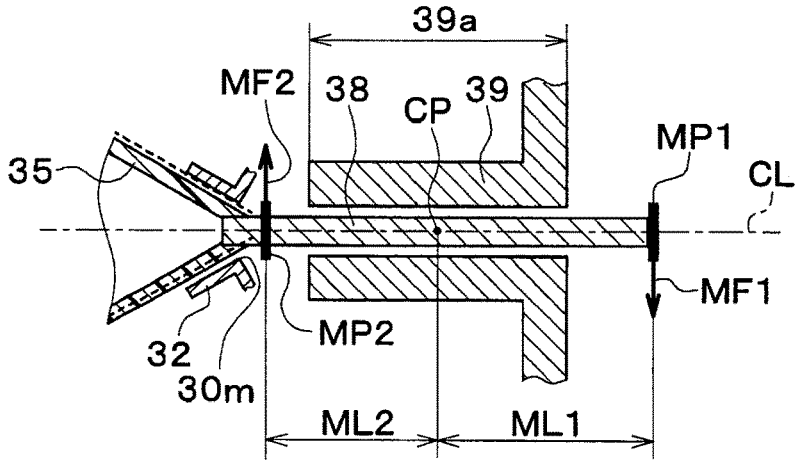
FIG. 8 is an explanatory view schematically showing positional relation among a first mobile end, a second mobile end, a rotation center, and the like according to at least one embodiment.

The above configuration will be described with reference to FIGS. 6 to 8. FIGS. 6 to 8 are explanatory views each schematically indicating positional relation among the slide region 39*a* of the support member 39, the first mobile end MP1, the second mobile end MP2, the rotation center CP, the passage formation member 35, and the throat portion 30*m* when viewed in the direction perpendicular to the center axis CL.

Figure 6:
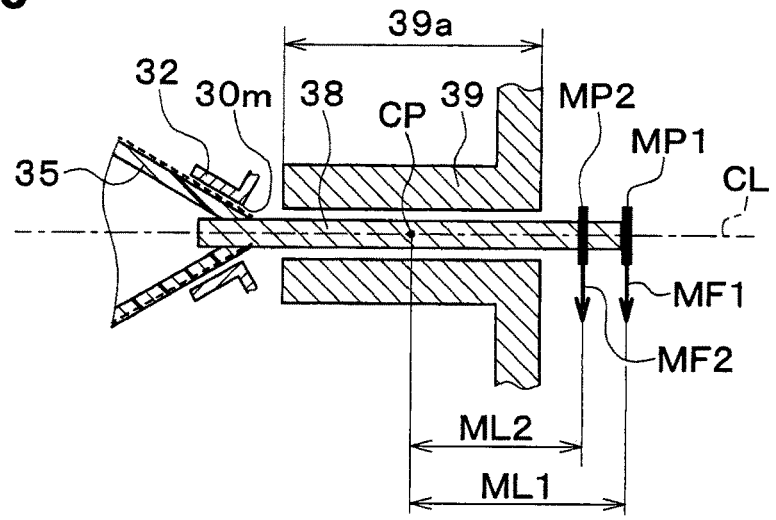
FIG. 6 is an explanatory view schematically showing positional relation among a first mobile end, a second mobile end, a rotation center, and the like according to at least one embodiment.

Initially, the present embodiment provides a formula F1 described below, expressing the maximum torque M generated by transverse force applied to the shaft 38 from the first elastic member and the second elastic member as depicted in FIG. 6.

$$M=MF1\times ML1+MF2\times ML2 \quad \text{(F1)}$$

In this formula, MF1 denotes transverse force applied from the first elastic member to the shaft 38, whereas MF2 denotes transverse force applied from the second elastic member to the shaft 38. Furthermore, ML1 denotes distance from the rotation center CP to the first mobile end MP1, whereas ML2 denotes distance from the rotation center CP to the second mobile end MP2.

FIG. 7 depicts a configuration according to a first comparative example, in which the first mobile end MP1 and the second mobile end MP2 are disposed on two different axial ends of the slide region 39*a* of the support member 39. More specifically, the first mobile end MP1 is disposed on the one end side of the slide region 39*a* in the axial direction, and the second mobile end MP2 is disposed on the other end side of the slide region 39*a* in the axial direction.

According to the first comparative example, similarly to the present embodiment, the throat portion 30*m* is disposed to be closest to the other end side of the slide region 39*a* in the allowable range where the throat portion 30*m* can be disposed. The second mobile end MP2 according to the first comparative example is thus disposed farther from the other end of the slide region 39*a* in the axial direction than the throat portion 30*m* is from.

The first comparative example accordingly provides a formula F2 described below, expressing maximum torque M1 generated by transverse force applied to the shaft 38 from the first elastic member and the second elastic member.

$$M1=MF1\times ML1+MF2\times ML3 \quad \text{(F2)}$$

In this formula, ML3 denotes distance from the rotation center CP to the second mobile end MP2 according to the first comparative example.

As described above, the throat portion 30*m* according to the first comparative example is disposed similarly to the throat portion 30*m* according to the present embodiment, so that ML3 is larger than ML2 according to the present embodiment. The maximum torque M according to the present embodiment is thus less than the maximum torque M1 according to the first comparative example. The present embodiment can thus suppress increase in frictional force between the shaft 38 and the support member 39 more effectively than the first comparative example.

Meanwhile, FIG. 8 depicts a configuration according to a second comparative example, in which the throat portion 30*m* is disposed farther from the other end of the slide region 39*a* in the axial direction than that in the first comparative example, and the second mobile end MP2 is disposed between the throat portion 30*m* and the other end of the slide region 39*a* in the axial direction. The second comparative example provides distance from the rotation center CP to the second mobile end MP2, set to ML2 as in the present embodiment.

The second comparative example accordingly provides a formula F3 described below, expressing maximum torque M2 generated by transverse force applied to the shaft 38 from the first elastic member and the second elastic member.

$$M2=MF1\times ML1+MF2\times ML2 \quad \text{(F3)}$$

That is, the maximum torque M2 according to the second comparative example is equal to the maximum torque M according to the present embodiment. The second comparative example can thus suppress increase in frictional force between the shaft 38 and the support member 39 more effectively than the first comparative example.

In the second comparative example, distance between the throat portion 30*m* and the other end of the slide region 39*a* in the axial direction is longer than the distance according to the present embodiment. In the second comparative example, the displacement direction of the shaft 38 and the passage formation member 35 being inclined from the center axis of the support member 39 largely shifts the passage formation member 35 from an ideal position, as shown by a broken line in FIG. 8. This leads to larger degree of circumferential ununiformity in sectional shape of the throat portion 30*m* of the nozzle passage 13*a*.

In contrast, the ejector 13 according to the present embodiment includes the throat portion 30*m* disposed to become closest to the other end of the slide region 39*a* in the axial direction in the allowable range where the throat portion 30*m* can be disposed. Even if the throat portion 30*m* is disposed outside the range overlapping the slide region 39*a* of the support member 39 when viewed in the direction perpendicular to the center axis CL, axial distance between the rotation center CP and the throat portion 30*m* can be decreased as short as possible.

Even when the displacement direction of the shaft 38 and the passage formation member 35 is inclined from the center axis of the support member 39, the ejector 13 according to the present embodiment suppresses a large shift of the passage formation member 35 from the ideal position, as shown by a broken line in FIG. 6. This leads to smaller degree of circumferential ununiformity in sectional shape of the throat portion 30*m* of the nozzle passage 13*a*.

The ejector 13 according to the present embodiment can thus achieve accurate change in passage sectional area of the throat portion 30*m* of the nozzle passage 13*a* according to driving force output from the drive mechanism 37. The ejector 13 also suppresses deterioration in energy conversion efficiency when pressure energy of the refrigerant is converted to velocity energy in the nozzle passage 13*a*.

The passage sectional area of the throat portion 30*m* of the nozzle passage 13*a* has a minimum passage sectional area determining the flow rate of the refrigerant flowing through the nozzle passage 13*a*. Smaller degree of circumferential ununiformity in sectional shape of the refrigerant passage in the throat portion 30*m* of the nozzle passage 13*a* effectively stabilizes the flow rate of the refrigerant flowing through the ejector 13.

The ejector 13 according to the present embodiment includes the projections 381 on the outer peripheral surface of the shaft 38. This configuration decreases a contact area between the shaft 38 and the support member 39, to further decrease frictional force between the shaft 38 and the support member 39.

Second Embodiment

Figure 9:
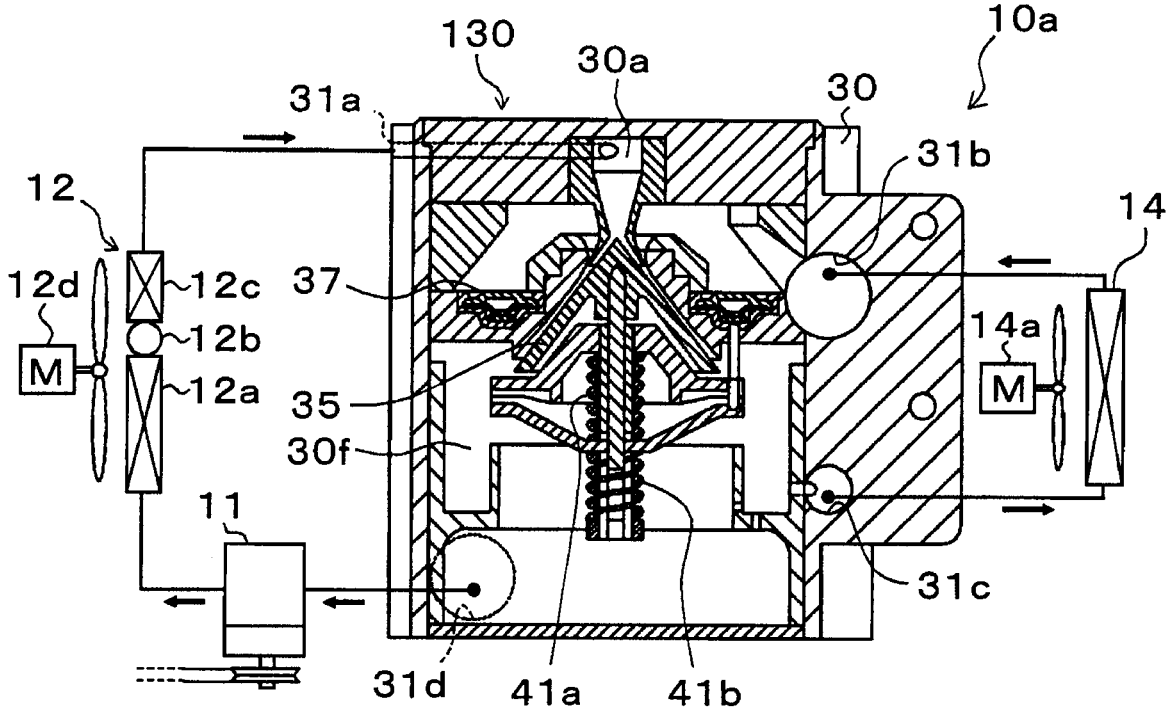
FIG. 9 is a view of an ejector refrigeration cycle according to at least one embodiment.

The present embodiment exemplifies an ejector 130 included in an ejector refrigeration cycle 10*a* depicted in FIG. 9.

Figure 10:
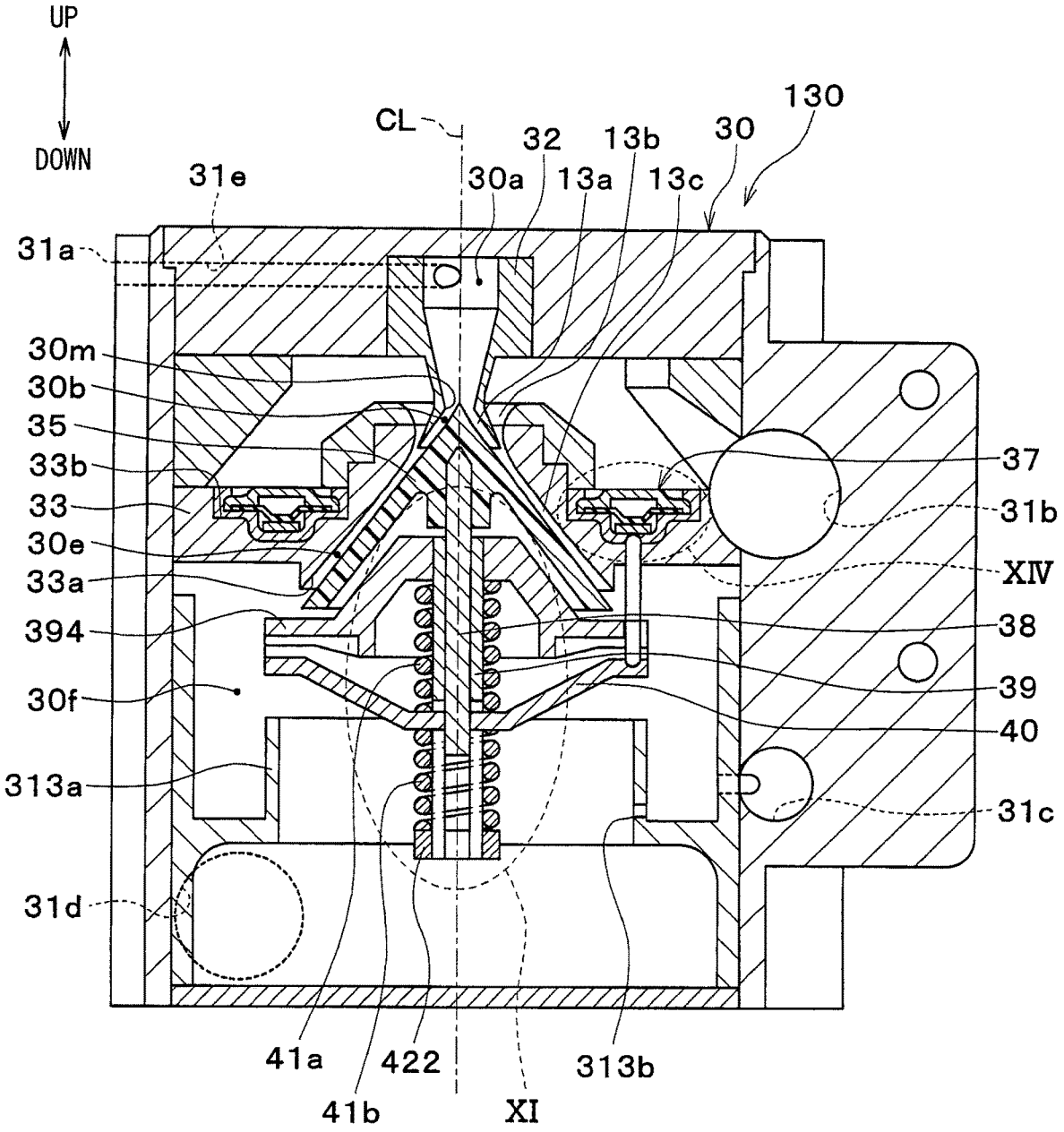
FIG. 10 is an axial sectional view of an ejector according to at least one embodiment.

The ejector refrigeration cycle 10*a* and the ejector 130 are basically configured similarly to the ejector refrigeration cycle 10 and the ejector 13 according to the first embodiment. In FIGS. 9 and 10, each portion identical to or equivalent to a corresponding portion according to the first embodiment is denoted by an identical reference sign. The same applies to the following drawings. FIG. 10 includes upward and downward arrows indicating up and down directions of the ejector 130 according to the present embodiment mounted to a vehicle.

Initially, in the ejector 130 according to the present embodiment, when viewed along the center axis CL, the refrigerant inflow passage 31*e* depicted in FIG. 10 is provided to cause the refrigerant flowing into the inflow space 30*a* to flow along an outer circumferential wall surface of the inflow space 30*a*. This configuration causes the refrigerant flowing from the refrigerant inflow passage 31*e* into the inflow space 30*a* to swirl about the center axis of the inflow space 30*a*.

The swirling refrigerant decreases pressure of the refrigerant adjacent to a swirl center in the inflow space 30*a* to reach pressure of bringing the refrigerant into a saturated liquid-phase state or pressure of pressure-reducing and boiling the refrigerant (causing cavitation). The ejector 130 according to the present embodiment facilitates boiling the refrigerant in the nozzle passage 13*a*.

The ejector 130 includes the shaft 38 coupled to the passage formation member 35 and extending downstream in the refrigerant flow (i.e. toward the gas-liquid separation space 30*f*) from the top of the passage formation member 35. The ejector 130 includes the support member 39, the load receiving member 40, a first coil spring 41*a*, a second coil spring 41*b*, and the like, which are disposed downstream (below in FIG. 10) in the refrigerant flow of the throat portion 30*m* of the nozzle passage 13*a*.

Figure 11:
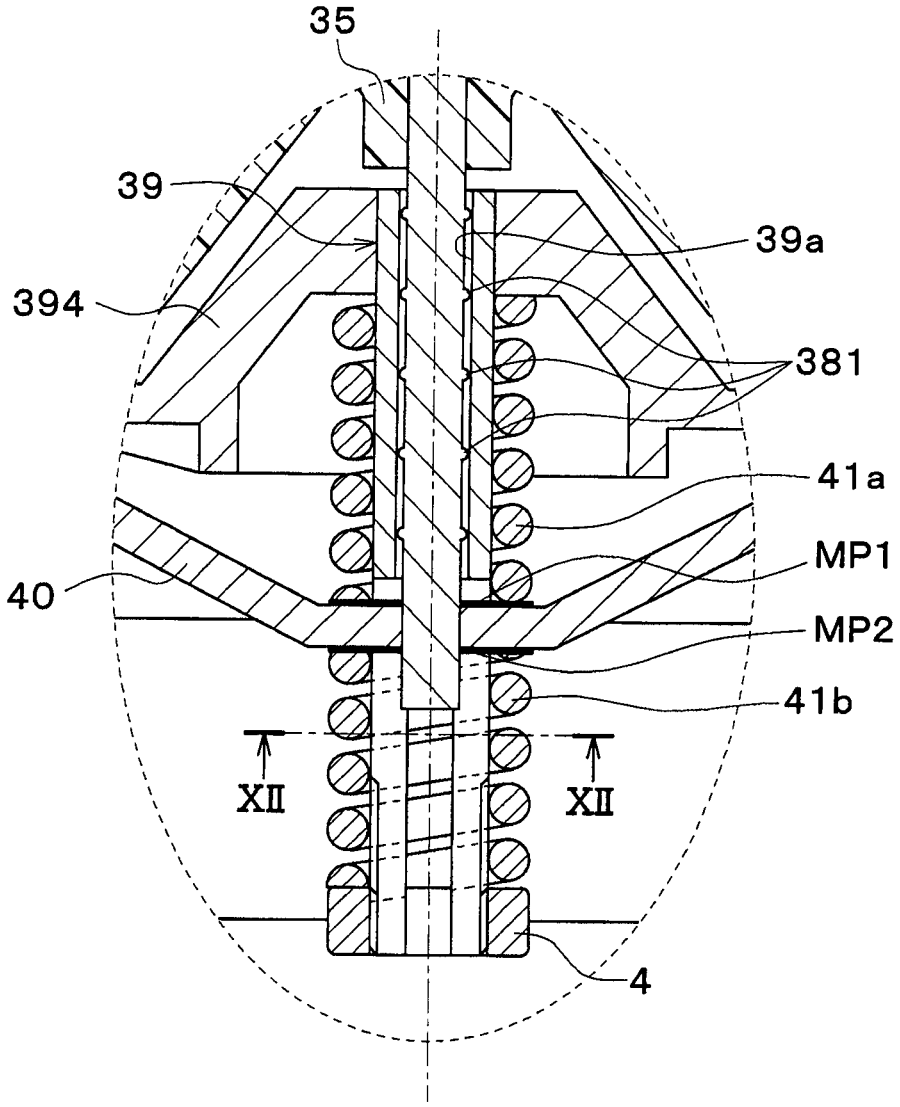
FIG. 11 is an enlarged sectional view of a part XI shown in FIG. 10.
Figure 12:
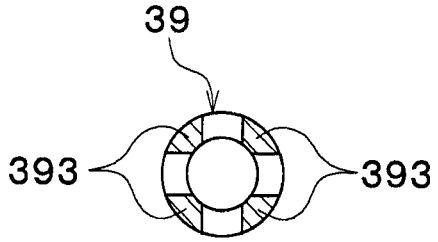
FIG. 12 is a sectional view taken along line XII-XII shown in FIG. 11.

More specifically, the support member 39 according to the present embodiment has a substantially cylindrical shape, as depicted in an enlarged sectional view in FIG. 11. The support member 39 has a plurality of (four in the present embodiment) legs 393 disposed downstream in the refrigerant flow, as depicted in FIG. 12. The support member 39 according to the present embodiment thus has the slide region 39*a* provided on an inner peripheral surface of a portion having a cylindrical shape, specifically, the inner peripheral surface of the portion not provided with the legs 393.

The support member 39 is fixed to the body 30 via an interposing member 394 having a substantially disk shape. The interposing member 394 fixes the support member 39 such that the center axis of the support member 39 agrees with the center axis CL of the pressure reducing space 30*b*. The outer peripheral surface of the shaft 38 according to the present embodiment also has the range that is possibly in contact with the slide region 39*a* and is provided with the plurality of projections 381 similarly to the first embodiment.

Figure 13:
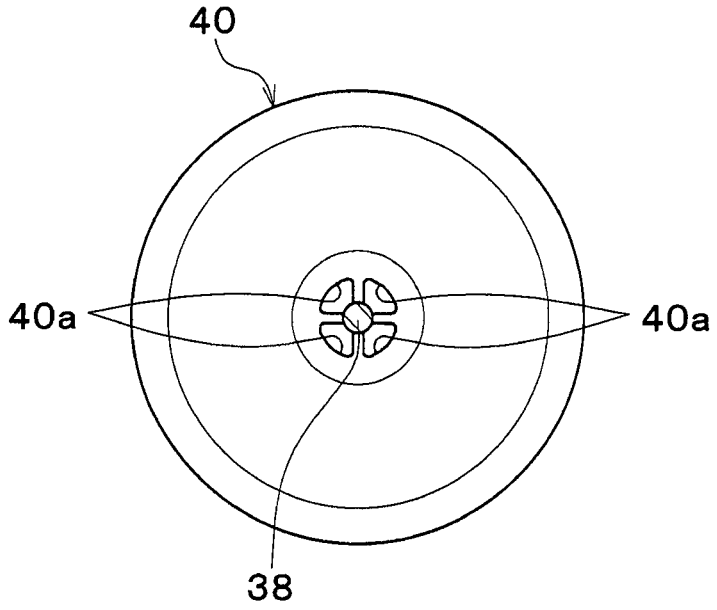
FIG. 13 is an axial front view of a load receiving member according to at least one embodiment.

The load receiving member 40 according to the present embodiment has a disk shape as depicted in a front view in FIG. 13. The load receiving member 40 has a center portion joined by welding or the like to a refrigerant flow downstream side of the shaft 38. As depicted in FIG. 13, the load receiving member 40 and the shaft 38 have a joint portion surrounded with a plurality of (four in the present embodiment) insertion holes 40*a* receiving the legs 393 of the support member 39.

As depicted in FIG. 11, the first coil spring 41*a* is disposed between the interposing member 394 and the load receiving member 40. The first coil spring 41*a* corresponds to the first elastic member applying a load to the load receiving member 40 and the shaft 38 in the direction of increasing the passage sectional area of the throat portion 30*m*.

As shown by a bold solid line at an upper end of the load receiving member 40 in FIG. 11, the first mobile end MP1 according to the present embodiment is an end of the first coil spring 41*a* that is movable to apply a load to the load receiving member 40.

The legs 393 of the support member 39 each have an outer periphery provided with a thread. The threads screw a nut 422.

The second coil spring 41*b* is disposed between the load receiving member 40 and the nut 422. The second coil spring 41*b* corresponds to the second elastic member applying a load to the load receiving member 40 and the shaft 38 in the direction opposite to the direction of the load applied by the first coil spring 41*a* (i.e. in the direction of decreasing the passage sectional area of the throat portion 30*m*).

As shown by a bold solid line at a lower end of the load receiving member 40 in FIG. 11, the second mobile end MP2 according to the present embodiment is an end of the second coil spring 41*b* that is movable to apply a load to the load receiving member 40.

The drive mechanism 37 according to the present embodiment will be described next. The drive mechanism 37 according to the present embodiment is disposed in a groove 33*b* having an annular shape and provided in a surface adjacent to the nozzle body 32 (an upper surface in FIG. 10) of the diffuser body 33. The drive mechanism 37 according to the present embodiment is basically configured similarly to the first embodiment.

Figure 14:
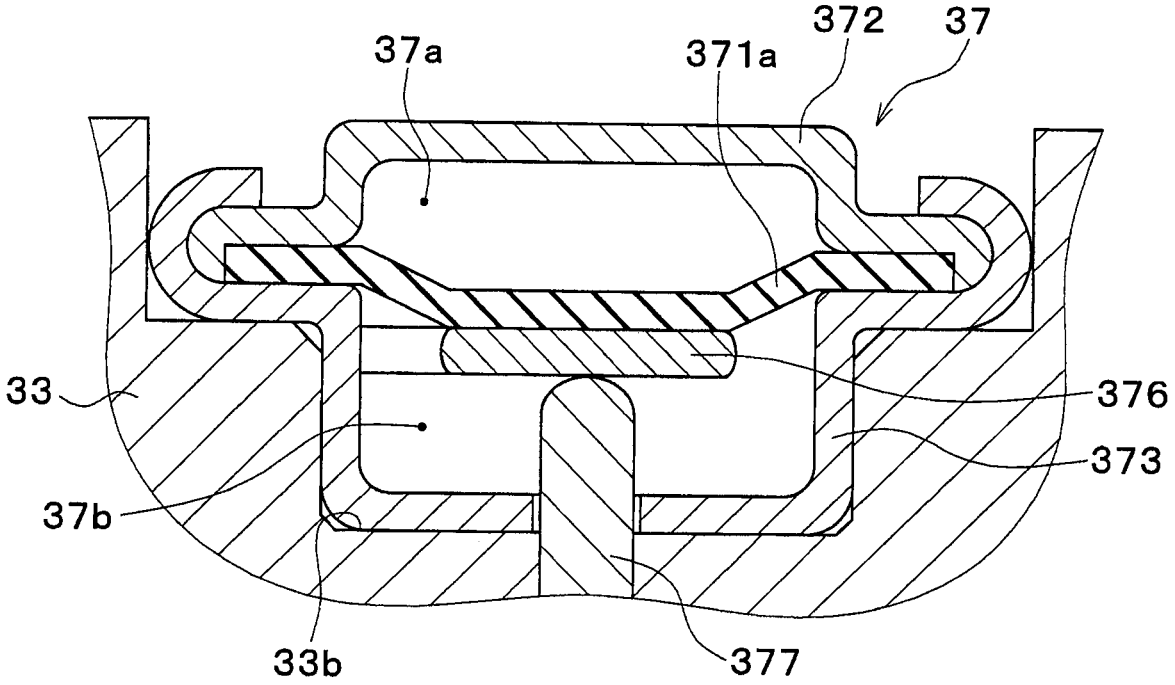
FIG. 14 is an enlarged sectional view of a part XIV shown in FIG. 10.

As depicted in FIG. 14, the drive mechanism 37 according to the present embodiment also includes a diaphragm 371*a*, the upper cover 372, the lower cover 373, and the like, which are provided therein with the enclosure space 37*a* and the introduction space 37*b*. The diaphragm 371*a*, the upper cover 372, and the lower cover 373 according to the present embodiment each have an annular shape and are sized to overlap the groove 33*b* of the diffuser body 33 when viewed along the center axis CL.

The diaphragm 371*a* having the annular shape according to the present embodiment is made of ethylene propylene diene rubber (EPDM) containing ground fabric (polyester). The diaphragm 371*a* according to the present embodiment that is made of rubber has an elastic force smaller than that of a diaphragm made of metal. The present embodiment thus additionally provides the first coil spring 41*a* serving as the first elastic member.

As depicted in FIG. 14, the introduction space 37*b* below the diaphragm 371*a* is provided therein with a ring plate 376 and a plurality of (three in the present embodiment) actuation bars 377 for transmission of displacement of the diaphragm 371*a* to the passage formation member 35. The plurality of actuation bars 377 is desirably disposed around the center axis CL at equal angular intervals to achieve appropriate transmission of displacement of the diaphragm 371*a* to the passage formation member 35.

The ring plate 376 is configured by a flat annular member made of metal (aluminum alloy in the present embodiment). The actuation bars 377 are each configured by a columnar member made of metal (aluminum alloy in the present embodiment). Each of the actuation bars 377 is disposed to have an upper end in contact with a lower surface of the ring plate 376 and a lower end in contact with an outer periphery of an upper surface of the load receiving member 40.

The shaft 38 and the passage formation member 35 according to the present embodiment are thus displaced to balance a total load of a load received from the first coil spring 41*a* at the first mobile end MP1 and a load received from the second coil spring 41*b* at the second mobile end MP2, and a load received from the drive mechanism 37 (specifically, the actuation bars 377).

The drive mechanism 37 according to the present embodiment displaces the passage formation member 35 so that the degree of superheat SH of the refrigerant at the outlet of the evaporator 14 approaches the predetermined reference degree of superheat KSH, as in the first embodiment. The reference degree of superheat KSH according to the present embodiment can be changed by adjusting loads of the first and second coil springs 41*a* and 41*b* by means of the nut 422.

The remaining basic configurations and operation of the ejector 130 are similar to those of the ejector 13 according to the first embodiment. Furthermore, the remaining configurations and operation of the ejector refrigeration cycle 10*a* are similar to those of the first embodiment.

Figure 15:
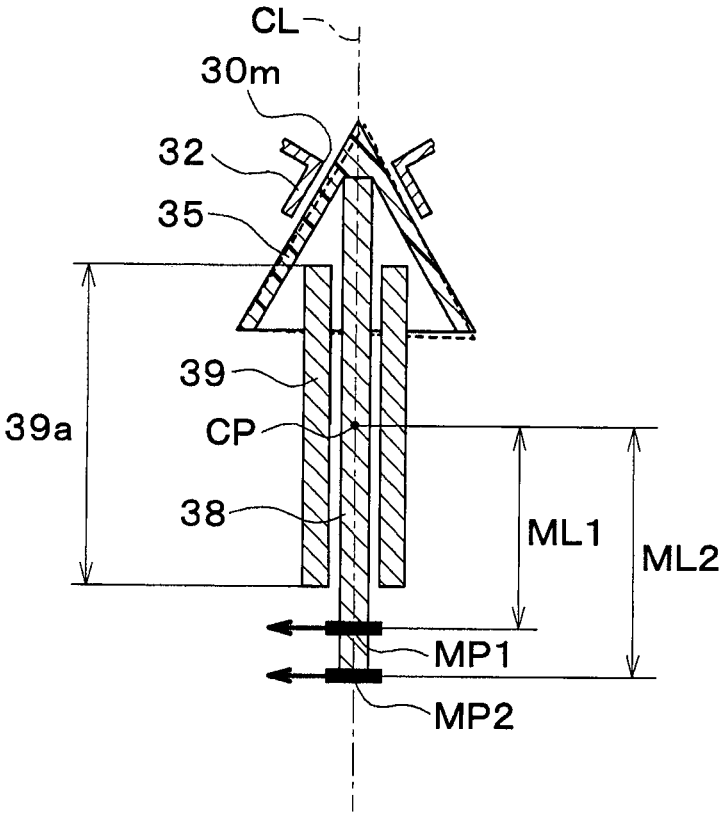
FIG. 15 is an explanatory view schematically showing positional relation among a first mobile end, a second mobile end, a rotation center, and the like according to at least one embodiment.

As depicted in FIG. 15, the ejector 130 according to the present embodiment thus has the first mobile end MP1 and the second mobile end MP2 that are, when viewed in the direction perpendicular to the center axis CL, disposed outside the range overlapping the slide region 39*a* as well as are both disposed on a same side of the slide region 39*a* in the axial direction. Similarly to the first embodiment, this configuration suppresses increase in frictional force between the shaft 38 and the support member 39.

The throat portion 30*m* is, when viewed in the direction perpendicular to the center axis CL, disposed to be closest to the one end of the slide region 39*a* in the axial direction in the allowable range where the throat portion 30*m* can be disposed. This configuration thus suppresses a large shift of the passage formation member 35 from the ideal position, as shown by a broken line in FIG. 15. This leads to smaller degree of circumferential ununiformity in sectional shape of the throat portion 30*m* of the nozzle passage 13*a*, similarly to the first embodiment.

The ejector 130 according to the present embodiment can thus achieve accurate change in passage sectional area of the throat portion 30*m* of the nozzle passage 13*a* according to driving force output from the drive mechanism 37, as in the first embodiment. FIG. 15 corresponds to FIG. 6 according to the first embodiment.

Third Embodiment

Figure 16:
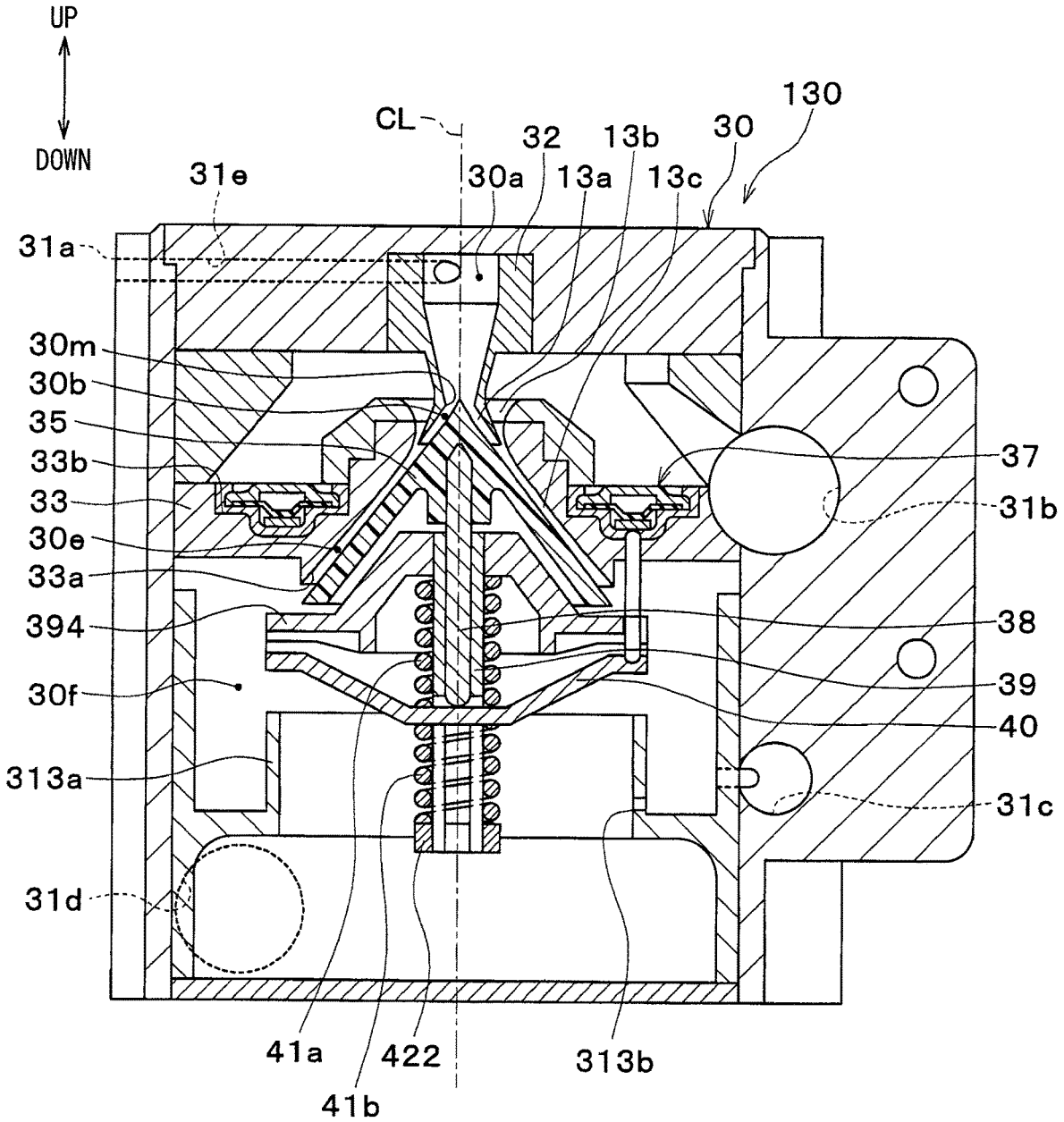
FIG. 16 is an axial sectional view of an ejector according to at least one embodiment.

The present embodiment exemplifies the ejector 130 including, as depicted in FIG. 16, the shaft 38 and the load receiving member 40 that are formed as separate members and are disposed to be in point contact with each other. More specifically, the shaft 38 has another end in the axial direction (a lower end in FIG. 16) having a spherical surface to be in point contact with the load receiving member 40 without being welded. The remaining configurations and operation of the ejector 130 are similar to those of the second embodiment.

Therefore, the ejector 130 according to the present embodiment can also achieve advantages similar to those of the second embodiment. In the ejector 130 according to the present embodiment, the shaft 38 and the load receiving member 40 are formed as separate members, to be unlikely to transmit, to the shaft 38, transverse force applied from the first elastic member and the second elastic member to the load receiving member 40.

The shaft 38 and the load receiving member 40 in point contact with each other effectively suppress transmission, to the shaft 38, of transverse force applied from the first coil spring 41*a* and the second coil spring 41*b* to the load receiving member 40. The inventors of the present disclosure have studied to find that the ejector 130 according to the present embodiment reduces by 50% hysteresis upon displacement of the passage formation member 35 by the drive mechanism 37.

The present disclosure is not limited to the embodiments described above, but can be modified in various manners within the range not departing from the purpose of the present disclosure.

(1) The first embodiment exemplifies the diaphragm 371 configured by the metal thin plate having excellent elasticity. Obviously, the diaphragm can alternatively be made of rubber as in the second and third embodiments.

As described in the second embodiment, a diaphragm made of rubber has elastic force smaller than a diaphragm made of metal. In the case where the ejector 13 according to the first embodiment includes such a diaphragm made of rubber, the ejector 13 can additionally include a coil spring 41*c* serving as the first elastic member, as depicted in FIG. 17.

Figure 17:
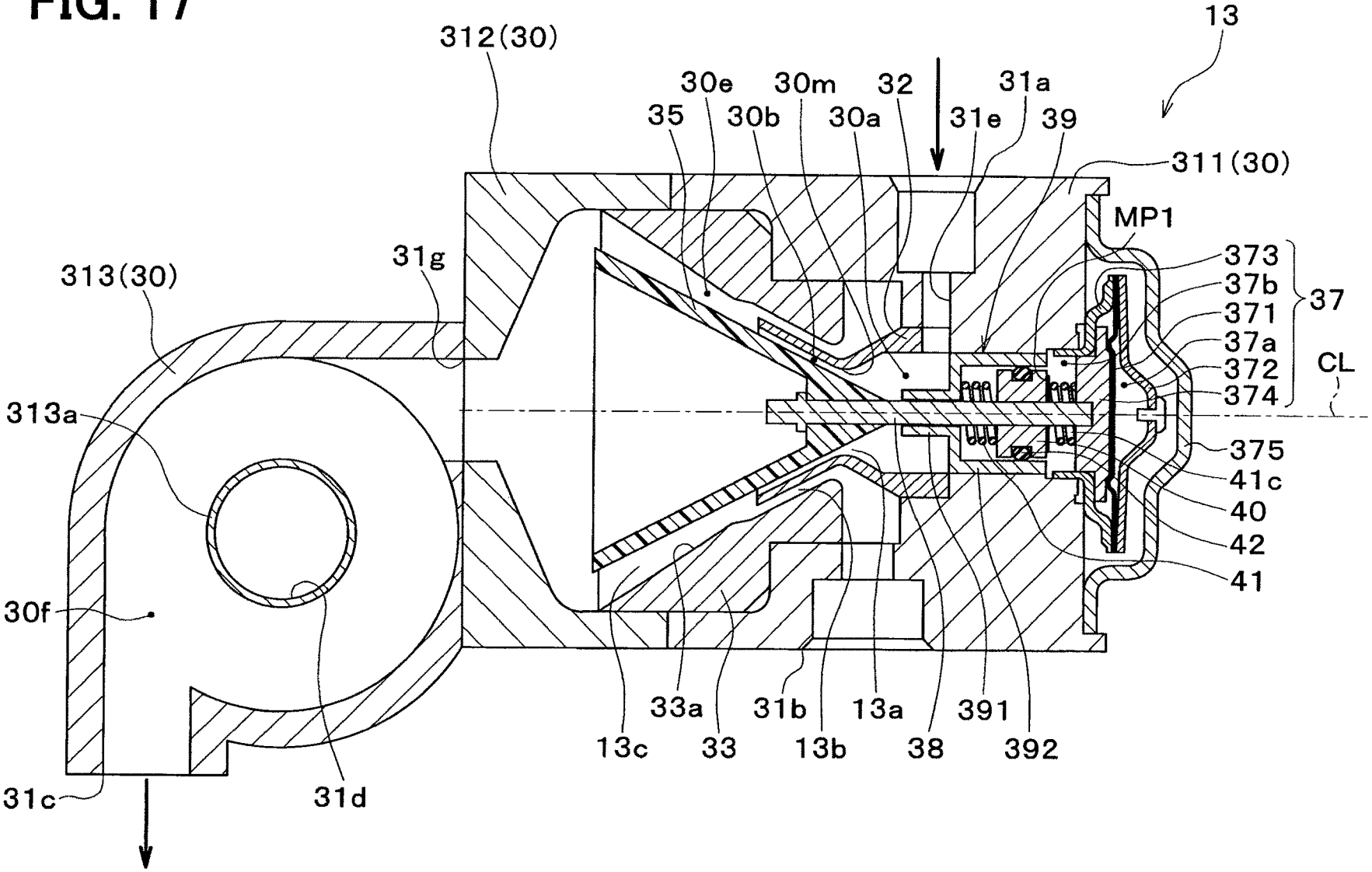
FIG. 17 is an axial sectional view of an ejector according to at least one embodiment.

As shown by a bold solid line on the right of the load receiving member 40 in FIG. 17, the coil spring 41*c* serving as the first elastic member has an end (specifically, a contact portion between the load receiving member 40 and the coil spring 41*a*) that is movable to apply a load to the shaft 38 (specifically, the load receiving member 40), and the end of the coil spring 41*c* corresponds to the first mobile end MP1.

Such a rubber diaphragm can alternatively be made of hydrogenated nitrile rubber (HNBR).

(2) The above embodiments exemplify the shaft 38 having the outer peripheral surface provided with the plurality of projections 381. Alternatively, the support member 39 can be provided, on the inner peripheral surface, with projections extending toward and being in contact with the outer peripheral surface of the shaft 38. In other words, the projections can be provided on one of the outer peripheral surface of the shaft 38 and the inner peripheral surface of the support member 39 to extend toward and be in contact with another one thereof.

(3) The components of the ejector 13 or 130 are not limited to those disclosed in the above embodiments in terms of materials, fixed states, and the like. The above embodiments exemplify the passage formation member 35 made of resin. The passage formation member 35 can alternatively be made of metal.

The first embodiment exemplifies the load receiving member 40 fixed by means of screw fastening to the outer circumference of the shaft 38. The load receiving member 40 can alternatively be fixed to the outer circumference of the shaft 38 by means of press fitting, welding, or the like.

(4) The component devices configuring the ejector refrigeration cycle 10 or 10*a* are not limited to those disclosed in the above embodiments.

For example, the above embodiments exemplify the compressor 11 configured by an engine-driven variable capacity compressor. The compressor 11 can alternatively be configured by a fixed capacity compressor that changes an operation rate of the compressor through connection and disconnection of an electromagnetic clutch to adjust refrigerant discharge capability. The compressor 11 can still alternatively be configured by an electric compressor that includes a fixed capacity compression mechanism and an electric motor and operates with supplied electric power. The electric compressor achieves control of refrigerant discharge capability through adjustment of rotational speed of the electric motor.

The above embodiments exemplify the radiator 12 configured by a subcooling heat exchanger. The radiator 12 can alternatively be configured by an ordinary radiator including only the condensing unit 12*a*. The radiator 12 can alternatively be configured by a receiver-integrated condenser that includes the ordinary radiator integrated with a liquid receiving device (receiver) that reserves an excess liquid-phase refrigerant obtained by gas-liquid separation of the refrigerant subjected to heat radiation at the radiator.

The drive mechanism 37 is not limited to that described in each of the above embodiments. For example, the temperature sensitive medium can alternatively include thermowax having volume changed by temperature. The drive mechanism can alternatively include an elastic member made of shape memory alloy. The drive mechanism can still alternatively be configured to displace the passage formation member 35 as an electrical mechanism such as an electric motor or a solenoid.

The above embodiments exemplify the refrigerant including R134a, but the refrigerant is not limited to this example. The refrigerant can alternatively include R1234yf, R600a, R410A, R404A, R32, R407C, or the like. Alternatively, a mixture refrigerant in which plural types of those refrigerants are mixed together or the like may be adopted. Furthermore, the refrigerant can alternatively include carbon dioxide to configure a supercritical refrigeration cycle that has high-pressure side refrigerant pressure reaching or exceeding critical pressure of the refrigerant.

(5) The above embodiments each exemplify the ejector refrigeration cycle 10 or 10*a* according to the present disclosure applied to the vehicle air conditioner, but the ejector refrigeration cycle 10 or 10*a* is not limited to such application. The ejector refrigeration cycle 10 or 10*a* can alternatively be applied to a stationary air conditioner, a cold storage warehouse, a cooling and heating device for a vending machine, or the like.

According to each of the above embodiments, the ejector refrigeration cycle 10 or 10*a* including the ejector 13 according to the present disclosure includes the radiator 12 that functions as an exterior heat exchanger configured to exchange heat between the refrigerant and outside air, and the evaporator 14 that functions as a use-side heat exchanger configured to cool blown air. Alternatively, the evaporator 14 can be applied as an exterior heat exchanger configured to absorb heat from a heat source such as outside air, and the radiator 12 can be applied as a use-side heat exchanger configured to heat heating target fluid such as air or water.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

The invention claimed is:

1. An ejector applied to a vapor-compression refrigeration cycle device, the ejector comprising:

a body including an inflow space that allows a high-pressure refrigerant to flow thereinto, a pressure reducing space that has a shape of a solid of revolution and reduces a pressure of the refrigerant flowing out of the inflow space, a suction passage that communicates with a downstream side of the pressure reducing space in a refrigerant flow and allows the refrigerant sucked from a refrigerant suction port to flow through the suction passage, and a pressurization space that allows the refrigerant jetted from the pressure reducing space and the refrigerant sucked through the suction passage to flow into the pressurization space;

a passage formation member at least partially disposed inside the pressure reducing space and at least partially disposed inside the pressurization space;

a drive mechanism configured to output driving force for moving the passage formation member;

a support member that has a cylindrical shape and slidably supports a shaft, the shaft having a cylindrical columnar shape and coupled to the passage formation member; and a vibration suppressive member configured to suppress vibration of the passage formation member, wherein:

a refrigerant passage provided between an inner peripheral surface of a portion of the body defining the pressure reducing space and an outer peripheral surface of the passage formation member is a nozzle passage functioning as a nozzle that reduces the pressure of the refrigerant and jets the refrigerant;

a refrigerant passage provided between an inner peripheral surface of a portion of the body defining the pressurization space and the outer peripheral surface of the passage formation member is a diffuser passage functioning as a pressurizing portion that mixes and pressurizes the jetted refrigerant and the sucked refrigerant;

a center axis of the support member is coaxial with a center axis of the pressure reducing space;

when viewed in a direction perpendicular to an axial direction of the pressure reducing space, a throat portion of the body at which a passage sectional area of the nozzle passage is smallest in the nozzle passage is positioned outside a range overlapping a slide region of the support portion on which the shaft is slidable;

the vibration suppressive member includes a first elastic member configured to apply a load to the passage formation member in a direction of increasing the passage sectional area of the nozzle passage, and a second elastic member configured to apply a load to the passage formation member in a direction opposite to the direction of the load applied by the first elastic member;

the shaft is one shaft connecting the first elastic member and the second elastic member;

an end of the first elastic member that is movable to apply the load via the shaft to the passage formation member is defined as a first mobile end;

an end of the second elastic member that is movable to apply the load via the shaft to the passage formation member is defined as a second mobile end;

when viewed in the direction perpendicular to the axial direction of the pressure reducing space, the first mobile end and the second mobile end are positioned outside the range overlapping the slide region, and both the first mobile end and the second mobile end are positioned on a same side of the slide region in the axial direction and positioned opposite another side of the slide region on which the throat portion is positioned;

the passage formation member has a conical shape; and an apex of the conical shape is located within the pressure reducing space, and a diameter of the conical shape increases in a direction of the flow.

2. The ejector according to claim 1, further comprising a load receiving member being in contact with the first mobile end and the second mobile end, wherein the shaft and the load receiving member are formed as separate members and are disposed to be in contact with each other.

3. The ejector according to claim 2, wherein the load receiving member and the shaft are in point contact with each other.

4. The ejector according to claim 1, wherein one of an outer peripheral surface of the shaft and an inner peripheral surface of the support member has a projection that projects toward and is in contact with another of the outer peripheral surface of the shaft and the inner peripheral surface of the support member.

5. The ejector according to claim 1, wherein the drive mechanism includes an enclosure space formation member having an enclosure space enclosing a temperature sensitive medium that undergoes pressure change in accordance with temperature change, an introduction space formation member having an introduction space allowing the sucked refrigerant to flow thereinto, and a pressure responsive member moved by change in pressure difference between the temperature sensitive medium and the sucked refrigerant, and the pressure responsive member is made of rubber.

6. An ejector applied to a vapor-compression refrigeration cycle device, the ejector comprising:

a body including a pressure reducing space that has a shape of a solid of revolution and reduces a pressure of refrigerant;

a passage formation member at least partially disposed inside the pressure reducing space;

a drive mechanism configured to move the passage formation member in an axial direction of the pressure reducing space;

a support member that has a cylindrical shape and slidably supports a shaft, the shaft having a cylindrical columnar shape and coupled to the passage formation member, the support member having a slide region on which the shaft is slidable; and a vibration suppressor configured to suppress vibration of the passage formation member, wherein:

a refrigerant passage provided between an inner peripheral surface of a portion of the body defining the pressure reducing space and an outer peripheral surface of the passage formation member is defined as a nozzle passage;

a center axis of the support member is coaxial with a center axis of the pressure reducing space;

when viewed in a direction perpendicular to the axial direction of the pressure reducing space, a throat portion of the body at which a passage sectional area of the nozzle passage is smallest in the nozzle passage is positioned outside a range overlapping the slide region of the support portion;

the vibration suppressor includes a first elastic member configured to apply a load to the passage formation member in a direction of increasing the passage sectional area of the nozzle passage, and a second elastic member configured to apply a load to the passage formation member in a direction opposite to the direction of the load applied by the first elastic member;

the shaft is one shaft connecting the first elastic member and the second elastic member;

an end of the first elastic member that is movable to apply the load via the shaft to the passage formation member is defined as a first mobile end;

an end of the second elastic member that is movable to apply the load via the shaft to the passage formation member is defined as a second mobile end;

when viewed in the direction perpendicular to the axial direction of the pressure reducing space, the first mobile end and the second mobile end are positioned outside the range overlapping the slide region of the support portion, and both the first mobile end and the second mobile end are positioned on a same side of the slide region in the axial direction and positioned opposite another side of the slide region on which the throat portion is positioned;

the passage formation member has a conical shape; and an apex of the conical shape is located within the pressure reducing space, and a diameter of the conical shape increases in a direction of the flow.

* * * * *